US005624107A

United States Patent [19]

Deguchi et al.

[11] Patent Number: 5,624,107

[45] Date of Patent: Apr. 29, 1997

[54] IMAGE FORMING APPARATUS WITH A DOCUMENT FEEDER

[75] Inventors: Masanobu Deguchi, Kashiba; Junichi Kajiwara, Tenri; Masakiyo Okuda, Ikoma-gun; Michiyuki Suzuki, Yamatokoriyama; Shinji Kato, Osaka; Hideaki Hagihara, Nara; Kazuhiko Yamakawa, Yamatokoriyama, all of Japan

[73] Assignee: Sharp Kabushiki Kaisha, Osaka, Japan

[21] Appl. No.: 570,003

[22] Filed: Dec. 8, 1995

[30] Foreign Application Priority Data

| | | | |
|---|---|---|---|
| Dec. 16, 1994 | [JP] | Japan | 6-313083 |
| Feb. 21, 1995 | [JP] | Japan | 7-031913 |
| Mar. 16, 1995 | [JP] | Japan | 7-057259 |
| Mar. 22, 1995 | [JP] | Japan | 7-062553 |

[51] Int. Cl.[6] ..... B65H 5/22

[52] U.S. Cl. ..... 271/3.2; 271/3.14; 271/3.15; 271/145; 271/272; 355/75

[58] Field of Search ..... 355/75; 271/3.14, 271/3.15, 3.16, 3.2, 9.09, 145, 265.01, 272, 4.1

[56] References Cited

U.S. PATENT DOCUMENTS

| | | | |
|---|---|---|---|
| 4,508,444 | 4/1985 | May et al. | 271/9.09 |
| 4,882,603 | 11/1989 | Sakata | 355/75 |
| 5,060,018 | 10/1991 | Watanabe | 355/75 |
| 5,464,205 | 11/1995 | Barg | 271/145 |

FOREIGN PATENT DOCUMENTS

| | | | |
|---|---|---|---|
| 360006540 | 1/1985 | Japan | 271/9.09 |
| 361051439 | 3/1986 | Japan | 271/3.14 |
| 0151522 | 7/1986 | Japan | 355/75 |
| 402052833 | 2/1990 | Japan | 271/3.14 |
| 402221042 | 9/1990 | Japan | 271/3.14 |
| 5-8886 | 1/1993 | Japan . | |
| 6-67497 | 3/1994 | Japan . | |

*Primary Examiner*—H. Grant Skaggs

[57] ABSTRACT

A feed roller for feeding a document is disposed between a control panel and an original table on the top of a copier body. A document stocker provided rotatably relative to an original cover on the original table is rotated so as to cover the control panel, whereby the original cover is raised from the original table to create some clearance. In this situation, a document is inserted through the document stocker from a document inserting port. The document thus inserted is detected by the operation of a detecting lever, which activates the feed roller to convey the inserted document to the original table. As the rear part of the document thus conveyed is detected by the operation of the detecting lever, the feed roller is deactivated. In this condition, copying operation is carried out so that an image of the document conveyed onto the original table is formed.

9 Claims, 19 Drawing Sheets

IMAGE FORMING APPARATUS WITH A DOCUMENT FEEDER

BACKGROUND OF THE INVENTION (1) Field of the Invention

The present invention relates to a preferable document feeder attached to an image forming apparatus such as copiers and the like. More specifically, the present invention is directed to an image forming apparatus equipped with a document feeder which automatically feeds an original document inserted from the outside to deliver it to an image forming station in an image forming apparatus and automatically discharges the document outside after a predetermined process is effected inside the image forming apparatus.

(2) Description of the Prior Art

In an image forming apparatus such as copiers, a copy document is placed on a transparent original table and then covered by an original cover. Then, as the operator starts the copying switch, a duplicated image of the original placed is reproduced on a sheet of paper as is conveyed in a proper manner.

In this case, if the copy original is of sheet-like material, it is troublesome to handle the document manually and place it on the original table. To deal with this, some copiers have an automatic document feeder on the top of the original table. That is, this document feeder has a document tray on which sheet-like original documents are placed and automatically delivers the sheet document by means of a paper feeding means. The document feeder successively feeds original documents placed on the document tray, one by one, from the topmost or lowermost sheet, in accordance with instructions from the copier body and delivers it to a station where the original is exposed to light. After the exposure, the feeder discharges the original to a document discharging tray. Since the document feeder is thus constructed, the apparatus becomes markedly large-sized and expensive.

Hence, when the automatic document feeder is attached to the copier body, the cost naturally becomes increased. In a case where one or some documents are to be copied, the use of automatic document feeder, rather takes time for copying a first document because the operator should set the document or documents on the document tray and then wait for the operation to start until both the copier and the document feeder become ready to make synchronism with one another. Accordingly, the automatic document feeder takes as much time as operator's manual handling of documents, if the number of documents to be copied is a few.

Accordingly, in order to effect reduction in cost and other purpose, an automatic document feeder as shown in FIG. 1 has been proposed in Japanese Patent Application Laid-Open Hei 6 No. 67,497. This document feeder has two exposure portions, or includes, in addition to a typical original table on which a document is placed and exposed to light to effect image forming, a separate exposure station to which a sheet original is inserted and conveyed one by one. In the figure, the document feeder designated at 102 is attached to an original cover 126 pivotably supported by a shaft 125, and includes: a document tray 130 utilizing the top face of the original cover 126; a drawing roller 131 for pulling a document D from the document tray 130; a feed roller 132; a guide plate 133 for guiding the document D to an exposure portion A on one side of an exposure glass 120; and a discharging roller 136 for conveying the original D from the exposure portion A.

In this arrangement, as the document feeder 102 starts to operate, a document D is fed from the document tray 130 and conveyed by a platen roller 134 and a driven roller 137 as nipped between the rollers. Then, the document D are passed through the discharging roller 136 and discharged to the output tray 135. In this while, in an optical system 121, a copy lamp 122 is moved right below the platen roller 134 and positioned at that place while the document D is moved through the exposure area A on the exposure glass 120 and copied.

In a normal copying operation where a document D is placed on the transparent original table 120 for image exposure and scanned by moving the optical system 121 along the exposure glass 120 to make a copy, the copy lamp 122 and the like are driven in response to a copy start signal to a position where exposure is to be made and then starts scanning in an exposure area B from the left to the right in the figure to complete a copy.

In the above document feeder disclosed in Japanese Patent Application Laid-Open Hei 6 No. 67,497, since the original cover over the exposure glass serving as an original table is used to deliver documents successively to the exposure station, the cost can be more or less reduced.

Nevertheless, since the different exposure area A is provided separately from the normal exposure area B so that the document from the document feeder is exposed in the exposure area A, the optical system must be controlled to move from the exposure position where the document is conveyed to the exposure position where the document is placed on the original table 120. Accordingly, the document feeder of this type also becomes complicated in structure and large-sized as the conventional automatic document feeder. Further, the document feeder requires both the document tray and the discharge tray for conveying documents from the former to the latter. In this respect, the document feeder is the same as the conventional automatic document hander, resulting in increased cost for that part.

Besides, in the above image forming apparatus with a document feeder, while copying operation is being effected with a document placed on the transparent original table 120, without using the document feeder but by manually opening the original cover 126; if another document is to be copied utilizing the document feeder and a cut-in key is operated, previously designated image forming conditions (copy mode) such as copy magnification, copy density, copy quantity, trimming setup, masking condition or other functional setup are canceled and the copier is set into the standard copy mode. At that moment, the copy mode of the designated image forming conditions is temporarily shunted and stored in the memory.

In such a configuration, if the operator forgets to operate the cut-in key, the copying operation is started in the copy mode set up for the image forming using the transparent original table 120, possibly yielding unwanted copy.

Further, when the cut-in copy operation using the document feeder has been completed and the operation is returned to the former mode; if the operator forgets to operate the cut-in key, the copying operation is started similarly as stated above, yielding unwanted copy. In the case where the operator operates the clear key in place of the cut-in key to set up the normal use mode, in order to effect a copying operation during a copying operation is under way, the operator should repeat the troublesome operation to re-enter the setup input for the image forming conditions when the operation mode is returned from the automatic document feeder mode to the former mode in which documents are manually replaced.

Particularly, if, without clearing the copy mode such as magnification, selection of paper size, copy quantity etc., for the previous operation using the transparent original table 120, a copying operation is made using the document feeder, the copying operation will be done in the undesirable mode. To avoid this situation, the copy mode designated for the previous operation should once be cleared before the apparatus enters the copy mode using the document feeder. However, if the copying operation in the former mode is to be done after the original-feeder mode using the transparent original table 120, the operator should repeat the troublesome input operation to set up the former mode.

SUMMARY OF THE INVENTION

It is therefore an object of the present invention to provide a document feeder having a simple structure, down-sized, reduced in cost and still having good operating performances. The present invention is to provide a document feeder which is convenient, in particular, for effecting copying operation of a single, or some or several documents and is able to convey a document to an exposure position where a document is placed.

The present invention has been achieved to attain the above object, and the gist of the invention are summarized as follows:

In accordance with a first aspect of the invention, an image forming apparatus equipped with a document feeder, comprises: an original table disposed on the top surface of the image forming apparatus body and having an original document placed thereon and exposing the original image to light; and an original cover hinged pivotably on one side thereof to be opened and closed for pressing a document onto the original table, and is constructed such that the document feeder includes: a rotational member hinged pivotably on the opposed side to the hinged portion of the original cover so as to be rotatable between the top surface of the original cover and the top panel surface of the image forming apparatus body in which the original table is formed; a feeding means disposed in a document inserting portion formed between the original cover and the top panel surface when the original cover is closed, for conveying an inserted document toward the original table; and a lifting mechanism for raising the original cover from the original table when the rotational member is rotated toward the panel surface of the image forming apparatus body.

A second aspect of the invention is an image forming apparatus equipped with a document feeder which is characterized in that, in the first configuration, the rotational member is constructed so that a storage space is created in cooperation with the original cover when the rotational member is closed over the original cover and so that the rotational member is also used as a document guide for an inserted document when the rotational member is rotated onto the panel plate.

A third aspect of the invention is an image forming apparatus equipped with a document feeder having the first configuration, further comprising: a detecting means disposed on a document inserting side of the feeding means, for detecting insert of a document; and a controlling means for controlling the drive of the feeding means, based on the document detection by the detecting means.

A fourth aspect of the invention is an image forming apparatus equipped with a document feeder having the second configuration, further comprising: a detecting means disposed on a document inserting side of the feeding means, for detecting insert of a document; and a controlling means for controlling the drive of the feeding means, based on the document detection by the detecting means.

In accordance with a fifth aspect of the invention, an image forming apparatus equipped with a document feeder, comprises: an original table disposed on the top surface of the image forming apparatus body and having an original document placed thereon and exposing the original image to light; and an original cover hinged pivotably on one side thereof to be opened and closed for pressing a document onto the original table, and in this apparatus, the document feeder includes: a rotational member hinged pivotably on the opposed side to the hinged portion of the original cover so as to be rotatable between the top surface of the original cover and the top panel surface of the image forming apparatus body in which the original table is formed; a feeding means disposed in a document inserting portion formed between the original cover and the top panel surface when the original cover is closed, for conveying an inserted document toward the original table; a lifting mechanism for raising the original cover from the original table when the rotational member is rotated toward the panel surface of the image forming apparatus body; a detecting means disposed on a document inserting side of the feeding means, for detecting insert of a document; and a controlling means for controlling the drive of the feeding means, based on the document detection by the detecting means and is constructed such that the controlling means activates the feeding means in response to the detection on the front end of an inserted document and deactivates the feeding means in response to the detection on the rear end of the document, whereby the document is kept with the rear end thereof held by the feeding means; and after completion of image forming of the document, the feeding means is driven in the reverse direction.

In accordance with a sixth aspect of the invention, an image forming apparatus equipped with a document feeder, comprises: an original table disposed on the top surface of the image forming apparatus body and having an original document placed thereon and exposing the original image to light; an original cover hinged pivotably on one side thereof to be opened and closed for pressing a document onto the original table; a document tray hinged pivotably on the opposed side to the hinged portion of the original cover so as to be rotatable between the top surface of the original cover and the top panel surface of the image forming apparatus body in which the original table is formed; a feeding means disposed in a document inserting portion formed between the original cover and the top panel surface when the original cover is closed, for conveying an inserted document toward the original table; and a lifting mechanism for raising the original cover from the original table when the document tray is rotated toward the panel surface of the image forming apparatus body, and is constructed such that the document feeder has a discharging means disposed between the original cover and the original table for pushing out the document placed on the original table toward the opposite direction to the document inserting portion, when the document tray is unfolded on the top panel surface of the apparatus body.

A seventh aspect of the invention is an image forming apparatus equipped with a document feeder which is characterized in that, in the sixth configuration, the feeding means effects reverse-rotation drive for discharging a document remaining on the original table, through a space formed between the document tray and the panel surface on the top of the image forming apparatus body, preceding to effecting forward-rotation drive to feed an inserted document toward the original table.

An eighth aspect of the invention is an image forming apparatus equipped with a document feeder which is characterized in that, in the sixth configuration, the feeding means is composed of upper and lower rollers and an additional roller disposed below the lower roller and in link therewith; and a document is conveyed onto the original table by the upper and lower rollers in the feeding means while the additional roller in cooperation with the lower roller in the feeding means discharges the document placed on the original table.

Finally, a ninth aspect of the invention is an image forming apparatus equipped with a document feeder having the sixth configuration, further comprising an original-cover built-in feeding means disposed on a document inserting side of the original cover and driven by the driving shaft of the feeding means.

In the above configuration, as the rotational member folded on the original cover is unfolded, the original cover is raised whereby a clearance is created between the original cover and the original table glass. When a document is inserted from the outside into the document detecting means provided below the handle portion of the original cover, the document detecting means detects the document. In response to the detection, the feed roller is rotated so that the document is automatically fed into the space between the original cover and the original table glass.

In this case, as the document detecting means disposed in the document inserting section detects the inserted document, the feed roller is activated to drive. This drive causes the inserted document to pass through the gap between the original cover and the original table, as being guided toward the original table, particularly by the document cover.

Then, when the rear end of the document is detected by the document detecting means, the feed roller is deactivated, and the feed roller is stopped with the rear end of the document nipped thereby. Thereafter, as an image forming operation of the document is done, the feed roller is reversed so that the document can be automatically discharged. As to this operation, if the discharging distance is set up at a shorter distance than that in the feeding operation, the feed roller is stopped with the front end of the document held by the feed roller. Owing to this feature, if a request for another copy of this document is made, the repeated copying operation can be done.

In the above case, if a request for repeated copy has not been made within a predetermined period of time, the system discharges the document and becomes prepared to copy a next document to be inserted. Here, if a multiple-number of copies are required, the number of copies can be inputted so that the document can be discharged only after the completion of the copy. Here, if the rotational member does not work as a guide for guiding the lower surface of the document, the document is stopped with its inserted end nipped as stated above. This configuration is markedly effective as a means for preventing the document from falling from the top portion of the copier body.

Further, if a previous user effected a normal operation (i.e., without using the document stocker) and left a document on the table glass, the document left behind can be pushed outside from the glass table by the document discharging means or by the feed rollers which is reversely driven as nipping the document.

DESCRIPTION OF THE PREFERRED EMBODIMENTS

Embodiments of the invention will be described in detail with reference to the accompanying drawings.

In the beginning, a first embodiment of the invention will be described.

Figure 1:
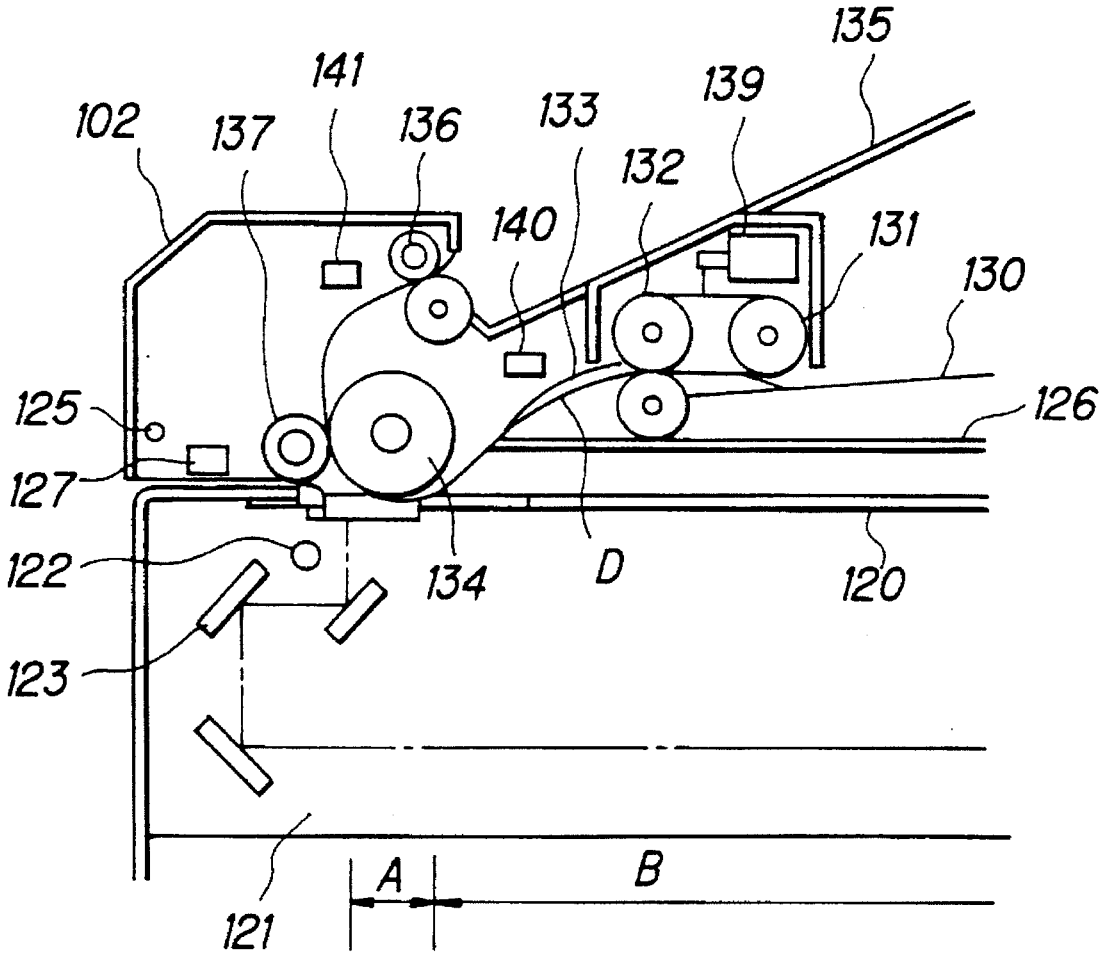
FIG. 1 PRIOR ART
FIG. 1 is a sectional view showing an example of an image forming apparatus equipped with a conventional document feeder.
Figure 2:
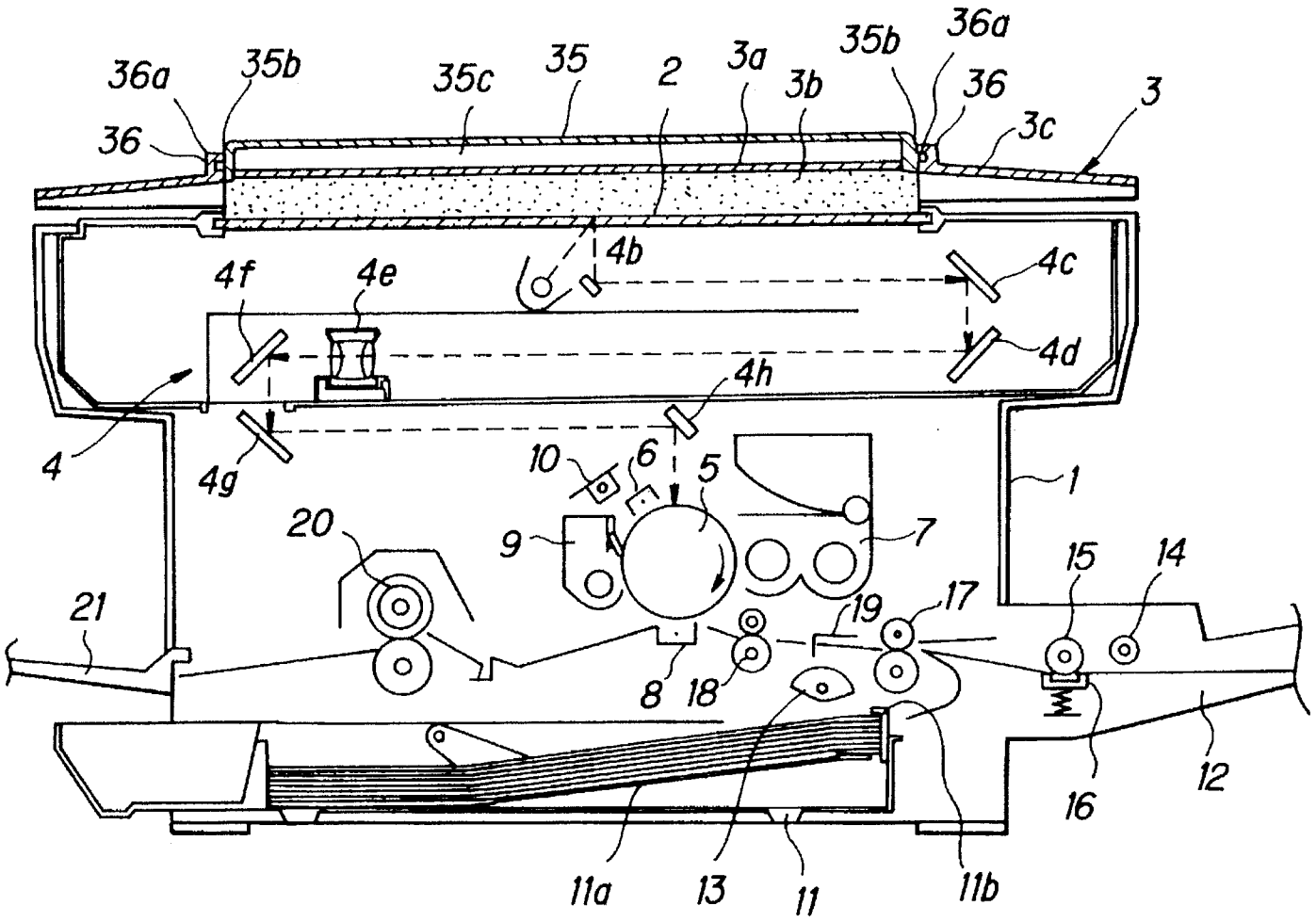
FIG. 2 is a schematically sectional view showing an inside configuration of a copier as an image forming apparatus equipped with a document feeder of the present invention.
Figure 3:
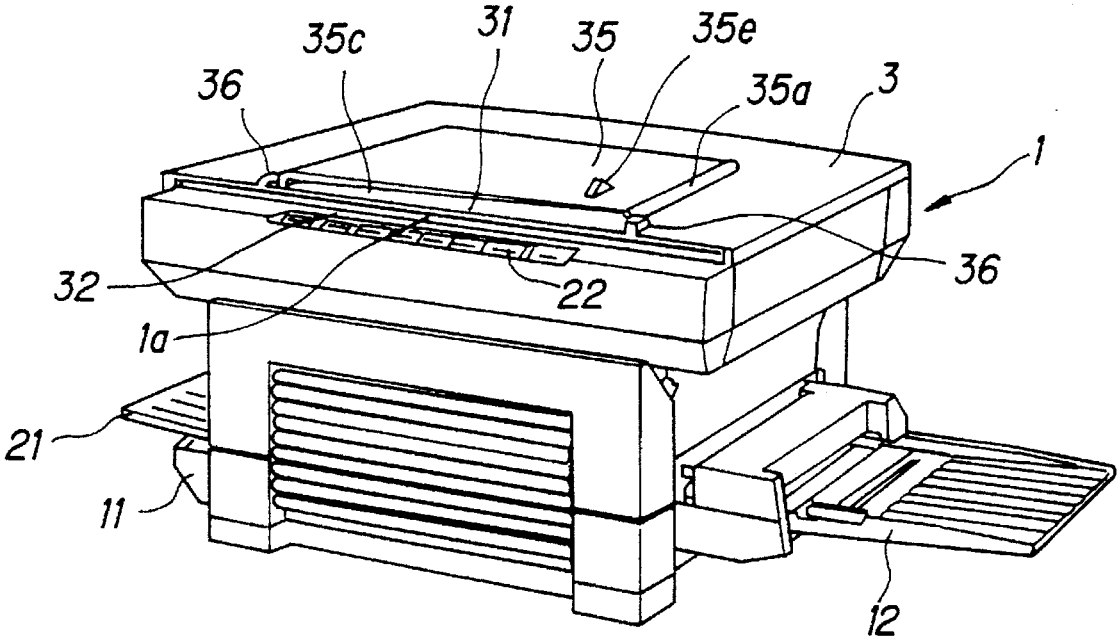
FIG. 3 is a perspective view showing an appearance of a copier as an image forming apparatus including a document feeder of the invention.

FIGS. 2 and 3 show an image forming apparatus equipped with a document feeder of the invention; specifically, FIG. 2 is a sectional view showing the internal structure of the copier and FIG. 3 is a perspective appearance view.

Referring first to FIGS. 2 and 3, the copier includes: an original table 2 for image exposure, of a transparent glass, disposed on a copier body designated at 1; and an original cover 3 disposed over the original table 2 and pivoted on one side in the rear part in the figure so as to be opened and closed. An optical system 4 is disposed inside the copier body 1 under the original table 2. The original cover 3 is to press the document placed on the original table glass 2 against the surface of the original table and is composed of an outer plate 3*a* formed of a relatively hard plastic resin and a document pressing mat 3*b* formed of a relatively soft material and attached inside the outer plate on the side facing the original table.

The optical system 4 includes: an exposure lamp 4*a* for light-scanning the document placed on the original table glass 2; mirrors 4*b*, 4*c* and 4*d* for leading reflected light from the original; a lens 4*e* for converging the reflected light having passed through the mirrors 4*b* to 4*d*; and mirrors 4*f*, 4*g* and 4*h* for leading the thus converged reflected light to the exposure point on the surface of a drum-type photoreceptor 5 positioned in a central part of the appliance. Particularly, the exposure lamp 4*a* and the reflecting mirror 4*b* are supported by a first moving member while the mirrors 4*c* and 4*d* are supported by a second moving member. The two moving members are moved in parallel with the original table 2, right and left in the figure. Specifically, the second moving member is driven at a half speed as fast as the first moving member moves. With this configuration, it is possible to pick up an image on the document placed on the original table 2 and guide the light image to be focused in a desired magnification onto the surface of the photoreceptor 5.

The aforementioned photoreceptor 5 is to form an image of the original placed on the original table 2. Provided around the photoreceptor are a main charger 6 for uniformly charging the photoreceptor surface, a developing unit 7 for developing an electrostatic latent image after exposure with colored toner, a transfer unit 8 for transferring the thus formed toner image onto a sheet material conveyed in time, a cleaning unit 9 for removing residual toner on the drum after the transfer, and an erasing lamp 10 for making the surface potential of the photoreceptor uniform for a next process. All the units are disposed around the photoreceptor 5, in the order of the description and constitutes an image processing system for image forming.

Separately from the above image processing system for image forming, a feeding system is provided inside the copier. The feeding system is to deliver a sheet of paper to the transfer station where toner image is transferred to the paper by the transfer unit 8 and peel off the paper with the toner image transferred, from the drum and discharge the paper outside the copier body. This feeding system comprises: a paper feeding port for feeding sheets of paper; a conveying portion for conveying the fed sheet to the aforementioned transfer station; and a paper discharging portion for discharging the paper with toner image transferred to the outside of the copier body.

The above paper feeding port includes: a paper holding portion (paper cassette) 11 detachably disposed on the bottom of the copier body 1; and a bypass feed tray 12 projected outside from the copier body 1 for manual insertion of paper.

Provided over the front (right in the figure) end portion of the paper holding portion 11 is a substantially semicircular feed roller 13, which delivers copy sheets P held in the paper holding portion 11, one by one from the topmost. Particularly, the paper holding portion 11 comprises: a rotating member 11*a* rotatably holding sheets P on the upper face thereof; unillustrated springs to urge the rotating member upward; and separating claws 11*b* for allowing sheets to be delivered one by one, and constructed so that the separating claws 11*b* regulates the topmost position of the sheets accommodated in a predetermined height.

The bypass feed tray 12 has a paper feeding means to successively deliver sheets one by one in response to the paper feed instruction. This paper feeding means comprises: a feed roller 14 for drawing one or more sheets placed on the tray 12; and a delivering manes composed of a delivering roller 15 and a separating member 16 for preventing two sheets from being delivered at the same time.

The conveying portion for conveying the sheet delivered through the paper feeding port of the above structure includes a pair of feed rollers 17 and 18. Provided on the downstream side (with respect to the sheet feed direction) of the feed roller 17 is a paper stopper plate 19, which temporarily stops the sheet conveyed by the feed roller 17. This paper stopper plate 19 is to start conveying the delivered sheet so that the front end of the sheet is adjusted with the front end of the toner image formed on the photoreceptor 5. That is, the paper stopper plate 19 is moved to open the feed passage in conformity with the rotational position of the photoreceptor 5, whereby the thus freed sheet is conveyed to the transfer station by the feed roller 17 and the conveyer roller 18 placed immediately before the transfer station.

Thus, these components constitute the paper conveying portion for conveying the copy sheet P to the transfer station which is opposed to the photoreceptor 5.

The sheet P passing through the transfer station is peeled off from the surface of the photoreceptor 5 and then lead to pass through a heat-fixing unit 20 which is disposed in the feed passage before the outside of the copier. This heat-fixing unit 20 is composed of a pair of rollers, that is, a heat-roller and a pressing roller which is pressed against the heat roller. The heat-fixing unit 20 conveys the sheet P as pressing it so that the unfixed toner image is fused by heat and fixed to the sheet. The sheet having passed through the heat-fixing unit 20 is discharged to the output tray 21 detachably disposed at the discharge port formed in the copier body 1. Thus, the paper discharging portion after the transfer is constructed.

The copier shown in FIG. 2 operates as follows: An image on the original document placed on the original table 2 is light-projected by the optical system 4, onto the photoreceptor 5 which has been uniformly charged by the main charger 6. The light projection of the original image creates an electrostatic latent image on the photoreceptor 5. The static latent image is then visualized into a toner image by the developing unit 7. This toner image is electrostatically transferred by the transfer unit 8 to the copy sheet being delivered in time by the above-described paper feeding system. The sheet with the toner image transferred is then delivered to the heat-fixing unit 20 where the toner image is fixed to the sheet as the sheet being conveyed. Then, the copy sheet P is finally discharged to the output tray 21.

Figure 4:
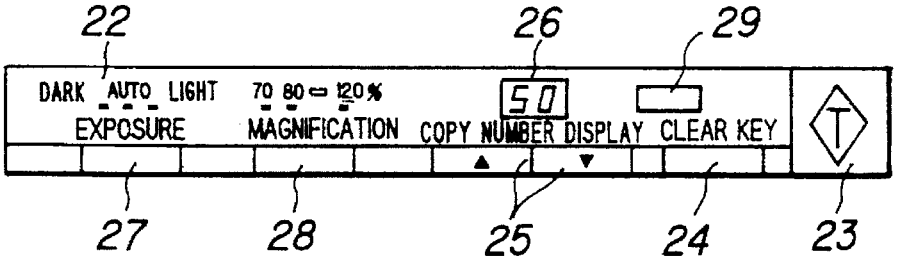
FIG. 4 is a plan view showing an example of a control panel used in an image forming apparatus of the present invention.

Provided below the original cover 3 on the front top of the thus configurated copier body 1 is a control panel 22 as shown in FIG. 3. This control panel 22 includes, as detailedly shown in FIG. 4, a copy button 23, a clear key 24, copy number setup keys 25, a copy number display portion 26, an exposure adjusting key 27 for adjusting whiteness and darkness of copy, a copy magnification setup key for setting up a copy magnification, a cut-in key 29 and the like.

Meanwhile, the document feeder of the invention includes the original cover 3, a part of the original cover and original feed rollers etc., disposed between the control panel 22 and the original cover 3. For example, a document feeder 30 comprises: a document feeding port 32 through which original documents are inserted; a document detecting lever 33 which is pressed up by the document inserted to turn on a document detecting switch; and feed roller unit 34 for feeding the inserted document onto the original table glass 2.

The aforementioned document feeding port 32 is formed between a grip portion 31 of the original cover 3 and flat portion of a top outer plate 1*a* of the copier body 1 for mounting the original table 2 of the copier body 1. The feed roller unit 34 is disposed between the original table 2 and the control panel 22 in the flat portion of the top outer plate 1*a* of the copier body 1. The feed roller unit 34 are composed of a feed (driving) roller 34*a* disposed above for driving and a roller 34*b* below. The lower roller 34*b* is rotatably supported by a distal end of a leaf spring 28 fixed at the other end to the upper frame and the like, disposed under the outer plate 1*a* so that the roller 34*b* comes into pressure contact with the feed (driving) roller 34*a*. The lower roller 34*b* may be provided on the copier body in such a manner, in place of being supported by the leaf spring 28, that the roller 34*b* is brought into pressure contact with the feed (driving) roller 34*a* by providing a spring or the like which urges the roller shaft upward.

The feed (driving) roller 34*a* of the above feed roller unit 34 is rotatably supported on the original cover side by a rotational shaft while rotational force is transmitted to the shaft from an unillustrated motor disposed in a site in the original cover 3.

The detecting switch and the detecting lever 33, constituting a detecting means for detecting an inserted document into the feed area toward the feed roller unit 34 also is disposed on the side of the original cover 3. When the original cover 3 is closed (or placed in the pressing state) over the original table 2, the detecting lever 33 is placed in an unillustrated depressed portion formed in the top outer plate 1*a* of the copier body. When a document is inserted, the lever 33 is lifted up above the outer plate 1*a*. This movement activates or turns on the document detecting switch, to thereby recognize the document.

Particularly, if the lower roller 34*b* also is disposed on the side of the original cover 3, it is possible to easily provide the document feeder, even for a copier with no document feeder, by replacing the original cover 3 with a new one having a document feeding function as described above.

As to the feed roller unit 34, although the feed (driving) roller 34*a* is, in particular, disposed on the original cover side, it is also possible to provide it for the copier body side like the lower roller 34*b*. In such a case, in order for the feed (driving) roller 34*a* not to become an obstacle when a document is manually placed onto the original table 2 with the original cover 3 opened and closed, the feed (driving) roller 34*a* should be capped by a separate covering member having an opening port on the document-inserting side thereof so as to allow the document to be inserted. Despite that the covering member protrudes more or less in the front portion above the original table 2, this arrangement allows the feed roller unit 34 to be accommodated inside, preventing the operator from jeopardy when placing documents. This configuration enables the switch and detecting lever 33 for document detection to be housed inside the covering member, simplifying the structure of the original cover 3.

Meanwhile, a document pressing mat 3*b* is provided on the inner side of the original cover and usually comes in close contact with the surface of the original table 2, by the self-weight. Hence, even if the document being inserted is conveyed by the feed roller unit 34, the document can not be inserted into between the document pressing mat 3*b* and the original table 2, but will be stopped and become stuck. Accordingly, it is necessary to lift the original cover 3 up to create such a gap between the original table 2 and the document pressing mat 3*b* as to allow the document to pass therethrough.

As a configuration of the lifting mechanism for lifting the original cover 3 up, a document stocker 35 is rotatably provided on pivot supporters 36 provided for the grip portion 31 on the front part of the outer plate of the original cover 3. The document stocker 35 has a bending portion 35*a* disposed on both sides and the rear side to define a space for accommodating documents etc., between the top face of the original cover 3 and itself. Formed on the front side of the stocker 35 is an opening 35*c* from which documents etc., are inserted into the top surface of the original cover 3.

A pair of pivots 35*b* are formed in the front part of the bending portion 35*a* on both sides of the stocker 35, so as to allow the document stocker 35 to rotate thereon. The pivots 35*b* are inserted into recesses 36*a* of the pivot supporters 36 provided on the front side of the outer plate 3*a* of the original cover 3. Particularly, when the outer plate of the original cover 3 is made of a resilient material such as resins etc., it is possible to fit the pivots into the pivots recesses by utilizing the resiliency. More specifically, the pivots 35*b* can be mated with the pivoting recesses 36*a* by warping the bending portion 35 around the pivots 35*b* so that the distance between the pivots 35*b* may become shorter than that of the pivot supporters 36 and aligning pivots with respective recesses and then releasing the deformation. Accordingly, the pivots 36*b* are fitted into respective pivot recesses 36*a* so that the document stocker 35 is rotatably supported relative to the original cover 3.

Thus, the document stocker 35 is pivoted. When the document stocker 35 is placed over the original cover 3, a space is formed by the top face of the original cover 3 and the bending portion 35*a* of the document stocker 35, so as to allow documents and any other necessary articles to be accommodated therein. This document stocker 35 is constructed in such a size as to accommodate originals having a maximum size, especially, maximum width, capable of being copied, as shown in FIG. 2.

Figure 6:
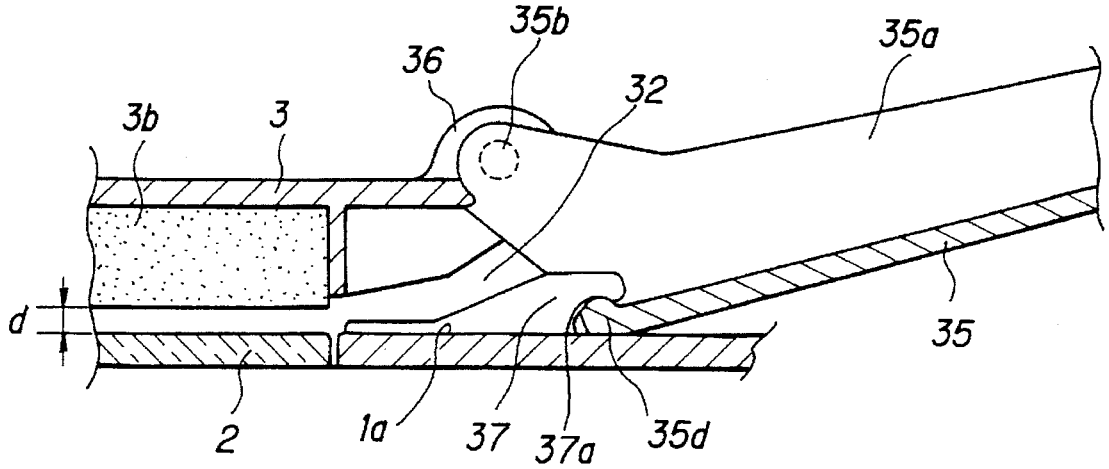
FIG. 6 is a sectional view showing a mechanism and state of lifting an original cover from an original table in a document feeder for conveying a document, equipped in an image forming apparatus of the invention.

In order for the document stocker 35 to lift up the original cover 3 so as to create a gap between the document pressing mat 3*b* and the original table 2, a pair of raising members 37 are provided on the upper portion of the outer plate 1*a* of the copier body side, in corresponding positions to the pivots 35*b*, as shown in FIG. 6. The raising member 37 protrudes in some degree toward the control panel 22 and has a hook portion 37*a* crooked more or less toward the lower part thereof.

Figure 5:
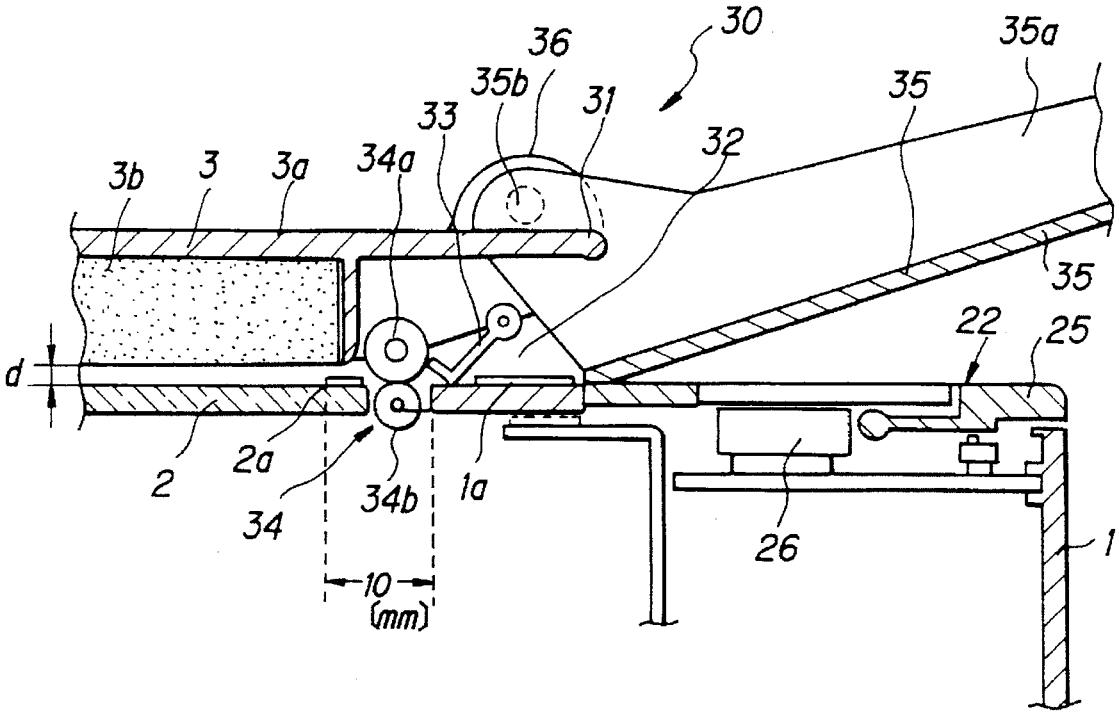
FIG. 5 is a sectional view showing essential components of a configuration of a document feeder equipped in an image forming apparatus of the invention.

FIGS. 5 and 6 are sectional views showing a document feeder of the invention when it is utilized. As shown in these figure, in position with the raising members 37, a pair of engaging portion 35*d* are formed on the side of the document stocker 35 to engage with the raising member 37. The engaging portions 35*d* are formed in the vicinity of the front part of the opening 35*c* of the document stocker 35, especially near the pivots 35*b*. Each engaging portion 35*d* has a projected form so as to be fitted into the hook portion 37*a*. The raising members 37 and the engaging portions 35*d* constitute an engaging mechanism.

Accordingly, when the document stocker 35 which is placed over the original cover 3 as shown in FIGS. 2 and 3 is rotated to this side until the document stocker 35 is positioned over the control panel 22, the one end portion of the document stocker 35 abuts the flat surface of the outer plate 1*a* so that the document stocker 35 may not make a further rotation. In this condition, the projected, engaging portions 35*d* of the document stocker 35 are engaged into the hook portions 37*a* of the aforementioned raising members 37. At this moment, one side of the peripheral edge portions defining the opening 35*c* of the document stoker 35 is supported by the top face of the outer plate 1*a* of the copier body 1. In this condition, the hook portions 37*a* of the raising members 37 are engaged with respective engaging portions 35*d*, whereby the original cover 3 is lifted upward by the pivots 35*b*. That is, the grip portion 31 opposed to the pivotable hinge on the rear side of the original cover 3 is raised upward on the hinge of the original cover 3 (disposed on the rear side of the copier shown in FIGS. 2 and 3) through the pivots 35*b* as the original stocker 35 is rotated. As a result, a gap 'd' is created between the original table 2 and the document pressing mat 3*b*.

In this arrangement, as a sheet document is inserted along the top surface of the document stocker 35 thus rotated, the inserted document can be conveyed by the feed roller 34*a* and guided through the gap between the original table 2 and the document mat 3*b* onto the original table 2.

The above gap 'd' is determined depending upon a distance between the engaging site of the raising member 37 and the engaging portion 35*d*, and the pivot 35*b*, and upon an angle formed between a line jointed between the pivots 35*b* and the engaging site, and the horizontal plane. That is, it is possible to obtain a desired gap 'd' by setting up these positional relations, properly.

One of the sides of the bending portion 35*a* of the document stocker 35 is used as a guide for guiding one side edge of an inserted document. That is, the document is registered by the two reference edges, one of which is the above-mentioned reference edge 2*a* on the original table 2 and the other is perpendicular to the reference edge 2*a*. One of the sides of the bending portion 35*a* of the document stocker 35 is formed so as to correspond to the latter reference edge. The opposite side of the bending portion 35*a* is spaced from the corresponding side of the bending portion 35*a* to the reference edge, by such a distance as to accommodate maximum-sized documents specified.

Figure 7:
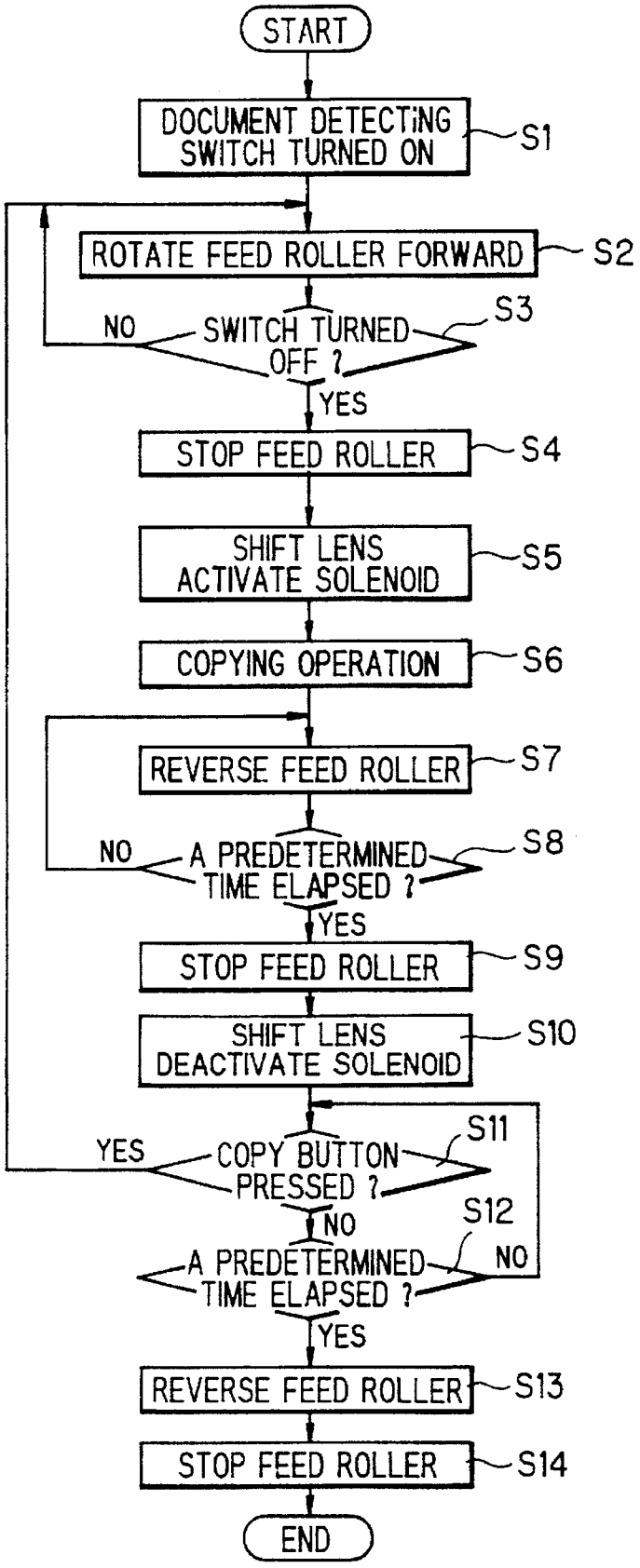
FIG. 7 is a flowchart showing a controlling operation in association with the operation control and image forming of a document feeder of the invention.

Referring next to a flowchart shown in FIG. 7, the operation of the copier and the document feeder 30 will be described. FIGS. 2 and 3 show a state where the original cover 3 is closed with the document stocker 35 positioned over the original cover 3. From this setting shown in the figure, the document stocker 35 is rotated to this side to be opened. By this operation, the hook portion 37*a* of the raising member 37 meshes the engaging member 35*c*, as shown in FIGS. 5 and 6, so that the document stocker 35 is lifted upward, creating the gap 'd' between the document pressing mat 3*b* and the original table 2. In the above setting, when a document D is inserted along the upper surface of the document stocker 35 from the document feeding port 32, the document D raises the detecting lever 33, to thereby turn the document detecting switch on (Step S1).

At the time of inserting the document, if, for example the left edge of the original table 2 in FIG. 2 is assumed to be a reference position for the placement of the document, the left side of the bending portion 35*a* of the document stocker 35 is adapted to coincide to the reference position, whereby it is possible to use the bending portion 35*a* to guide the front part of the document. By this arrangement, it is possible to deliver the document to the original table 2 in place with its front side aligned with the reference position.

As the document detecting switch is activated by the inserted document, the feed roller 34*a* starts to rotate in the forward direction or in the document feeding direction (in the clockwise direction in FIG. 5) (Step S2), the document D is fed into a gap 'd' between the document pressing mat 3*b* and the original glass table 2. In this case, the opposed face of the document pressing mat 3*b* to the original table 2 serves as a document guide. The gap 'd' is preferably 0.1 mm or more by considering that a typical paper sheet is about 0.08 mm thick. The clearance 'd' can easily be adjusted as stated before.

Thereafter, when the rear end of the document D goes through the detecting lever 33 and the document detecting switch turns off (Step S3), the feed roller unit 34 stops turning (Step S4) while the rear end of the document D is kept nipped by the feed roller unit 34.

In this way, as the document D is automatically fed onto the document table 2, the copier starts to perform the same copying operation as will be effected when the copy button 23 is pressed, whereby the copier effects reproducing procedures from the exposure to the discharge of copy paper (Step S6). In this case, the copying operation is carried out with the rear end of the document D nipped by the feed roller unit 34. Therefore, the placement of the document differs by, for example, about 10 mm, as shown in FIG. 5, from where the usual operation is done without using the document feeder 30. Since the rear end of the document is kept nipped by the feed roller unit 34, the difference is the distance between the nipped edge and one reference side of the original table 2. To cancel this difference, in this embodiment, the lens **4*e*** in the optical system is shifted from a reference position so that the center of the document D may coincide with the that of the copy sheet P.

Specifically, the copier is constructed so that activation of the document switch may start the same copying operation as is effected when the copy button 23 is pressed. Accordingly, with no pressing of the copying button 23, insertion of a document turns the original detecting switch on, to thereby start the copying operation. Before the activation of the copying operation, the lens **4*e* is shifted by about 5 mm by means of an unillustrated solenoid or motor for lens-shifting, so that the nipped document D may be image-formed on the photoreceptor 5** with the focused image of the edge shifted by 10 mm.

Accordingly, it is possible to make the focused image on the photoreceptor coincide with the feed reference position of the copy sheet delivered as usual (Step S5). For this purpose, the lens **4*e* is provided so as to be able to move in the direction perpendicular to the optical axis (in the forward and rearward directions in FIG. 5). When copying operation is done by automatic document handling, the copier is so set up that the lens 4*e* is shifted about 5 mm toward the front side in FIG. 2, or rightward in FIGS. 5 or 6. In this case, the undersurface of the supporting frame of the original table 2, in particular, the region around the nipped portion of the document where the light is illuminated by the optical system should preferably be white, since the reflected light from this area is projected on the photoreceptor 5**. If this area has a dark color, toner would be adhered onto the corresponding area and transferred to the copy sheet, resulting in formation of a black strip of about 10 mm in width.

In this condition, copying operation is effected in Step S6. After the completion of the process, the feed roller unit 34 is turned in the reverse direction by the driving motor (Step S7), the document D is delivered out toward the document feeding port 32. This discharge is performed by previously memorizing the rotating time of the feed roller unit 34 when the document D is inserted and measuring a setup time which is a little shorter (by a time equivalent to about 10 mm in feed distance) than the memorized time (Step S8) and stopping the reverse movement of the feed roller unit 34 after the passage of the thus setup time (Step S9).

Accordingly, the document D stops at a position where the end of the document D is nipped in some degree by the feed roller unit 34. In this condition, if another copy is wanted and the copy button is pressed within a predetermined period (for example, 2 seconds) after the feed rollers stopped, the feed roller unit 34 starts turning in the forward direction and the system reenters copying operation.

Thus, it is possible to take a multiple number of copies. After the predetermined time passed, the feed roller unit 34 is again reversed, whereby the document D is discharged to the document stocker 35. It is noted that if the number of copies for a document is specified previously, it is possible to easily obtain a required number of copies in a single operation.

As has been described, duplication of a single document is performed using the document feeder 30. If two or more documents are to be copied, the operator should put the finished document onto the top flat face of the original cover 3 and insert a next sheet document into the document feeding port 32 to effect a similar copying operation to thereby obtain desired copies.

In accordance with this embodiment, the document is fed in a direction perpendicular to the direction in which copy sheets are conveyed. Accordingly, since copying is effected with one side edge of the document nipped, the centers of the copy sheet and the document will not coincide with one another. To avoid this situation, the focusing lens is moved in the direction perpendicular to the optical axis of the lens, whereby the centers of the document and the copy sheet are made coincident.

Nevertheless, it is also possible to convey the document in the same direction as the copy sheet is conveyed. That is, for example, the original cover 3 is hinged on the right side in FIG. 2 while a document feeding port may be formed on the opposite side to the hinged portion. The other components may be configurated in the same manner as described above. In this case, the document is exposed to light with the rear end of the document nipped 10 mm, for example, the front end of the image formed on the photoreceptor is positioned different by 10 mm from the front end of the copy sheet conveyed. To cancel this discrepancy can be easily done by effecting control of driving so as to make the timing of delivering the copy sheet, earlier by a time equivalent to about 10 mm in feed distance. Specifically, the timing or opening the stopper 19 shown in FIG. 2 may and should be made earlier by a time equivalent to about 10 mm in feed distance.

In the configurations described above in which the image of the document is directly projected to the photoreceptor, the deviation of centers between the document and the copy sheet or the difference of the front end of the sheet from that of the image formed is unavoidable. This can be dealt with by using a digital image forming apparatus in which the image of a document placed is picked up digitally so that the picked up data is written onto the photoreceptor with laser beams. In such an image forming apparatus, the aforementioned center difference between the document and the copy sheet or the positional deviation between the copy sheet and the formed image can be modified or corrected when illumination of laser beams is to be done. That is, partial image area which is of the original but is not placed on the original table 2 is assumed to be plain area, whereby the total image containing the plain area may and should be written in on the photoreceptor 5 by laser illumination. To pick up an image digitally, a typical process is effected as follows: That is, a CCD or the like should be disposed after the focusing lens **4*e*. The picked up image data from the document by the CCD is A/D converted to be stored. Then, the laser beams modulated based on the stored digital image data are illuminated on the photoreceptor 5**, whereby a static latent image corresponding to the image of the document can be created with dots.

As described heretofore, the document feeder 30 of this embodiment can be constructed by the simple means, so that it is possible to markedly contribute to reducing the cost. In the above description, the document stocker 35 for creating a gap 'd' between the original cover 3 and the original table 2 is configurated as holding documents etc., but this is not a must but a mere rotational member can be used, in place of the document stocker 35. However, since, in the above embodiment, the document stocker 35 has both functions, it is advantageous that the member can be used as a storage if the document feeder is not used. When the document stocker 35 is used for the document feeder, the document stocker 35 not only serves the bottom guide of inserted documents, but also serves as a discharge tray when documents are discharged.

Figure 8:
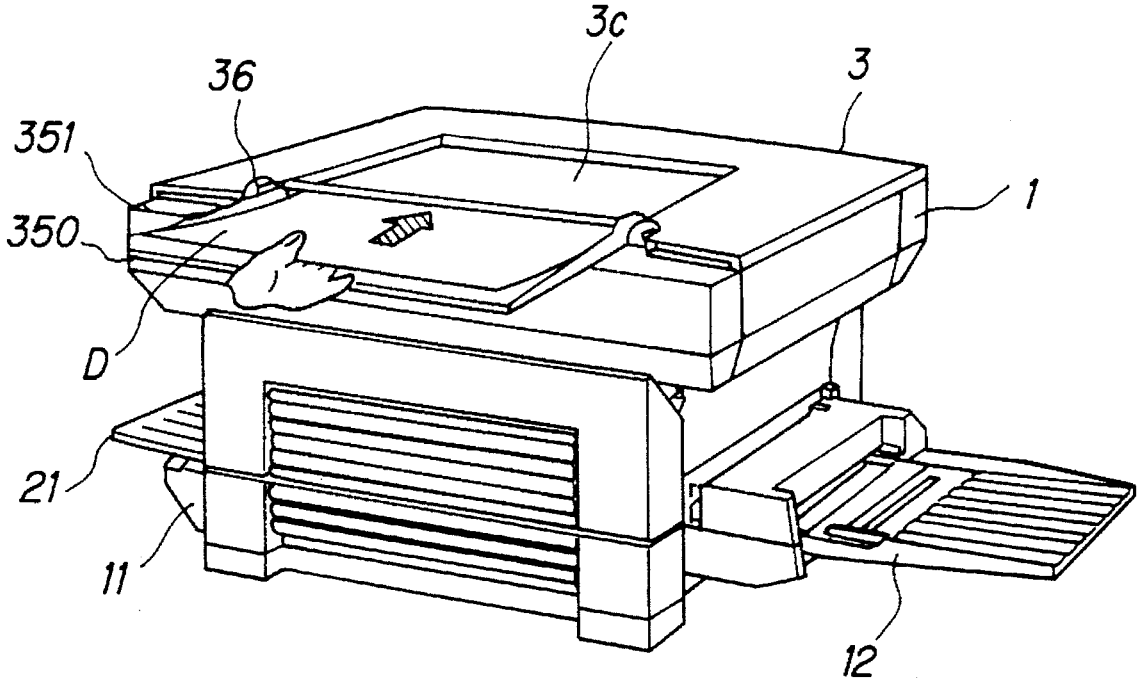
FIG. 8 is a perspective view showing another embodiment of an image forming apparatus equipped with a document feeder of the invention.

FIG. 8 shows another embodiment in which the original cover 3 is formed with a recessed portion 3*c* to make a holding portion of documents etc. Also, a rotational member 350 may be provided which is rotatable to mate with the recessed portion 3*c*. This configuration, in which the rotational member 350 is fitted in the recessed portion 3*c* of the original cover 3, has no protrusion on the surface of the original cover 3, this makes it possible to put documents etc. on the top. A guiding piece 351 may and should be formed for the rotational member 350 on, at least, the side corresponding to the reference position of the original table 2. This guiding piece can and should also be accommodated into the recessed portion 3*c*.

As has been described heretofore, according to the image forming apparatus of the invention, since a simple document feeder is provided which includes a feeding means disposed on one side of the original table for delivering documents into between the closed original cover and the original table, it is possible to reduce the cost as of a copier with a document feeder.

Particularly, since the member for accommodating originals etc., can be used for forming a gap between the original table and the original cover, this simple gap-forming means is able to contribute to reduction of the cost.

Further, the member for accommodating originals etc., by itself can be used as a document inserting guide.

Since this image forming apparatus is able to effect copying operation by feeding a document with its rear end of the document nipped without the document cover being opened and discharge the document from the rear end thereof after the completion of the copying operation and allows the operator to insert a next document as required, it is possible to obtain the same work performances as in the conventional automatic document feeder in which documents are inserted manually one by one.

Next, a second embodiment of the invention will be described with reference to drawings. The basic structure of the image forming apparatus to which the second embodiment is applied is the same with that shown in FIGS. 2, 3 and 4, therefore the description will not be repeated. A term SPF mode hereinbelow is an abbreviation of 'Single Paper Feed mode' and indicates a mode in which a single document is placed on the document tray so as to effect copying operation.

Figure 9:
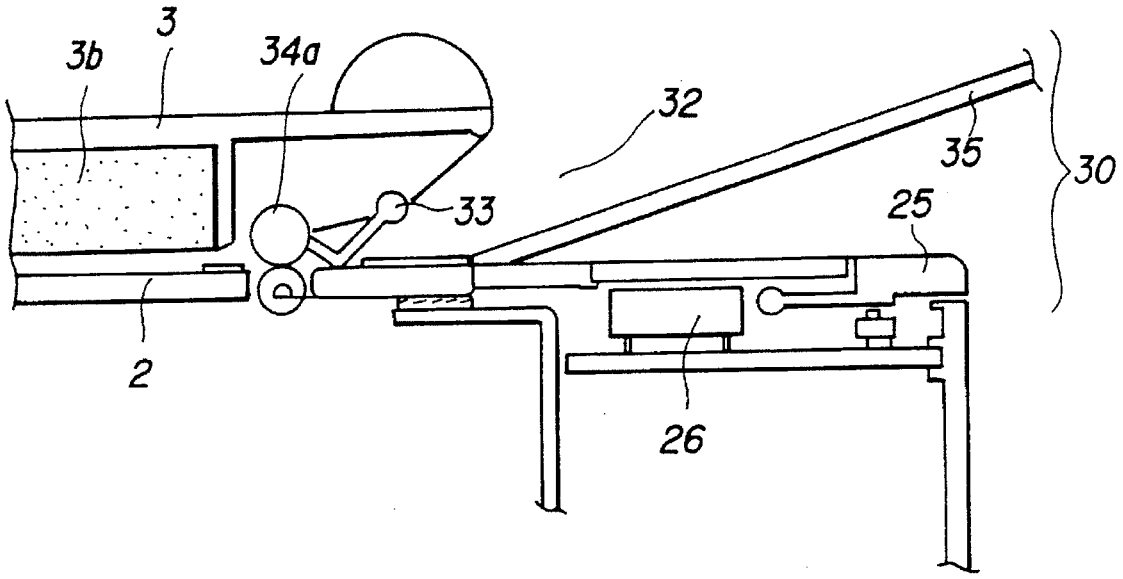
FIG. 9 is a sectional view showing a document feeder of the invention.
Figure 10:
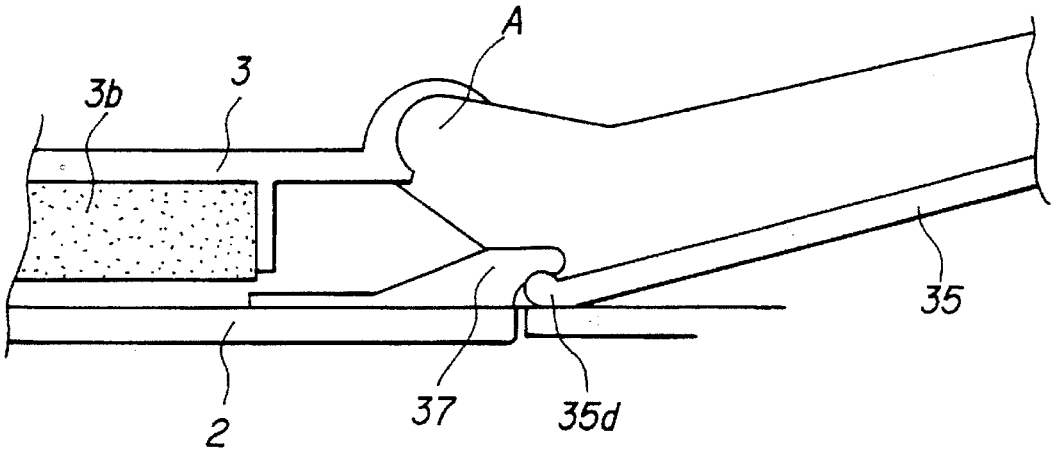
FIG. 10 is a view showing a jointing portion of an original cover with a document tray (document stocker) in a document feeder of the invention.

Referring first to FIGS. 9 and 10, a document feeder 30 is placed in front of the document pressing mat 3*b* under the front grip portion of the original cover 3 and includes: a document feeding port 32 through which original documents are inserted; a document detecting lever 33 which is pressed up by the document inserted to turn on a document detecting switch; a feed roller 34*a* for feeding the inserted document onto an original table 2; and other components. Further, when the document stocker 35 placed over the top of the original cover 3 is unfolded, the document stocker 35 serves as an original tray and presses the original cover 3 upward by means of guiding portions 35*d* of the document stocker 35. The guiding portion 35*d* of the document stocker 35 mesh claws 37 of the main appliance body, whereby the original cover 3 is fixed to the main appliance body.

In the normal copy mode (in which the document stocker is unused), if an operator has forgotten to pick up the document copied and if a next operator tried to effect copying operation in the SPF mode, there is a need for previously removing the document left by the former operator. If this removal of the document is not done, the two documents are laid over one another, thus proper copy cannot be done or the documents might be damaged. In order to avoid this situation, the following means is provided which is able to discharge an unremoved document (left document).

Figure 12:
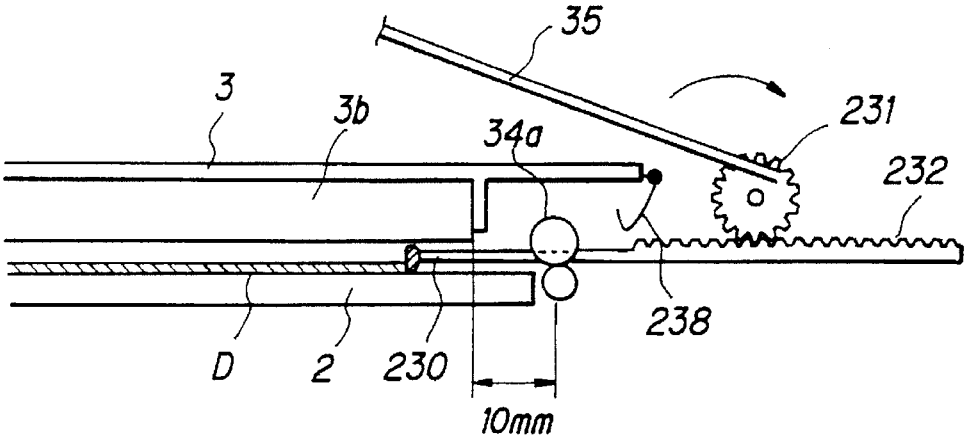
FIG. 12 is a sectional view showing a document discharging means (a first configuration) of the invention.

In FIG. 12, as the document stocker 35 is opened or closed, a pinion 231 provided on the pivot-supporting portion of the document stocker rotates, whereby a rack 232 positioned below and mated with the pinion is inserted into between the mat adhered to the original cover and the table glass. The rack is linked with a blade plate 230 sliding on the table glass. This blade plate 230 presses the document D left on the table glass after the previous copy operation, toward the opposed side to the stocker. After pushing the document out, the blade plate is placed in the backside of the front end of the document delivered in the SPF mode using the document stocker, so that it does not become an obstacle against the document.

Next, referring to a flowchart shown in FIG. 11, the operation of the document feeder 30 and the copier body will be described. As shown in FIG. 12, as a document D is inserted from the document feeding port 32 after the document stocker 35 is opened with the original cover 3 closed, the detecting lever 238 is moved up by the document D to turn on the document detecting switch (S21 to S23).

When the document detecting switch is activated, the feed roller 34*a* starts to rotate in the forward direction (S24) and the document D is inserted into a gap between the original glass table 2 and the document pressing mat 3*b*. At that time, the lower side of the document pressing mat 3*b* functions as a document guide. The clearance should preferably be 0.1 mm or more since a typical sheet of paper is 0.08 mm thick.

When the document D goes through the detecting lever 238, the document detecting switch is turned off (S25). This deactivates the feed roller 34*a* (S26) and therefore the document D stops with its rear end held by the feed roller 34*a*.

Then, as the document D is automatically fed onto the original table glass 2, the copier enters the copying operation in the same manner as the copy button 23 is pressed. That is, the copier starts to effect copying process from the exposure to discharging the copied sheet (S27 and S28).

In the above case, since the copying operation is performed with the rear end of the document D held by the feed roller 34*a*, the document D is positioned in a place deviated about 10 mm, as shown in FIG. 12, from where the document is to be placed when the document feeder 30 is not used. In order to cancel this deviation, in this embodiment, the position of the lens in the optical system is adapted to shift from its normal position so that the center of the document D may coincide with the that of the copy sheet.

Specifically, the situation when the document detecting switch is activated, is equivalent to the situation when the copy button 23 is pressed. Accordingly, as the document detecting switch is activated, the lens 4*e* is moved by 5 mm by means of a solenoid for lens-shifting, so that the focused image of the document D may be shifted by 10 mm to correspond to the reference position of the conveyed copy paper (S27).

As the copying operation at Step S26 is complete, the feed roller 34*a* turns in the reverse direction (Step S29) to discharge the document D to the document feeding port 32. The discharging operation is performed by memorizing the rotating time of the feed roller 34*a* when the document D is inserted and measuring a setup time which is a little shorter (by a time equivalent to about 10 mm in feed distance) than the memorized time (Step S30) and stopping the reverse rotation of the feed roller 34*a* after the passage of the thus setup time (Step S31). Accordingly, the document D stops at a position where the end of the document D is nipped to some extent by the feed roller 34*a*. In this condition, if another copy is wanted and the copy button is pressed within a predetermined period (for example, 2 seconds) after the feed rollers stopped, the feed roller 34*a* starts turning in the forward direction and the copying operation restarts. Thus, it is possible to take a multiple number of copies. After a predetermined time passed, the feed roller 34*a* is again reversed, whereby the document D is discharged to the document stocker 35 (S32 to S36).

In the above operation, the document discharging means of this embodiment is to discharge the left document before a new document is inserted, in a stage indicated by *1, or by opening the document stocker.

Next, another variation of the invention will be described with reference to FIGS. 13A, 13B and 13C as well as to FIG. 11.

Figure 13A:
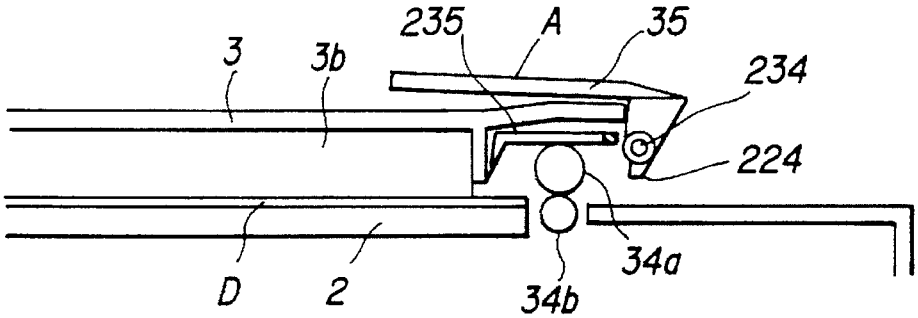
FIG. 13A is a sectional view (with a document tray folded) showing a document discharging means (a second configuration) of the invention.
Figure 13B:
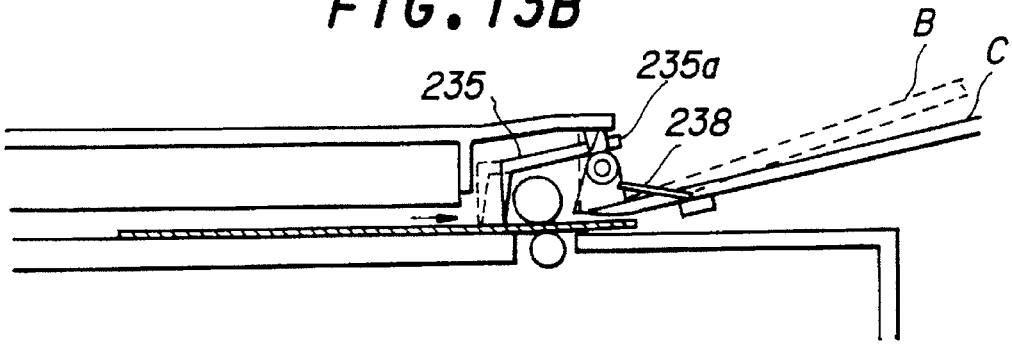
FIG. 13B is a sectional view (with a document tray unfolded) showing a document discharging means (a second configuration) of the invention.

Referring first to FIGS. 13A and 13B, as the document stocker 35 is opened, a hook portion 35*d* formed near the pivot-supporting portion of the document stocker moves about the rotary supporting point 234 of the stocker from a first position A through a second position B to a third position C. The hook portion 35*d* moves a document drawing hook 235 which is disposed above and in contact with the feed roller 34*a*. Specifically, the hook portion 35*d* moves up the bearing portion 235*a* of the hook 235, to cause an opposite tip end of the document drawing hook 235 to abut the top face of the document D and pull the document toward the direction indicated by an arrow in the figure. The thus drawn document is nipped between the feed roller 34*a* and pressing roller 34*b*, and driven by the rotation of the feed roller to be discharged to under the document stocker.

Figure 13C:
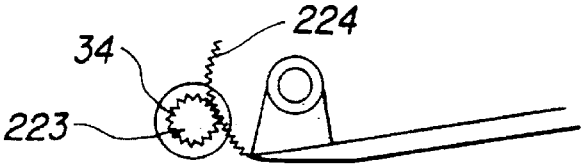
FIG. 13C is a detailed view of a pivoting portion of a document tray in FIGS. 13A and 13B.

Further, there is a gear 223 fixed coaxially on the same shaft of the feed roller 34*a* and a mating gear 224 fixed on the pivot supporting point of the stocker 35 (see FIG. 13C). As the stocker is set (or moved from A through B to C) in a state that the document pulled in the direction of the arrow 236 is sandwiched between the feed roller 34*a* and the pressing roller 34*b*, the previously nipped document is discharged outside by the reverse rotation of the feed roller, which is driven by the engagement of the gears 223 and 224.

It is also possible to construct the system as an application of the above embodiment so that, in the condition where the document pulled as above in the direction of arrow is held between the feed roller 34*a* and the pressing roller 34*b*, the driving motor (not shown) for the feed roller is adapted to activate the feed roller in the reverse direction, simultaneously when a document for the SPF mode is placed on the stocker and the detecting switch 238 is turned on. By this operation, the nipped document is discharged to the outside of the OC cover.

Figure 11:
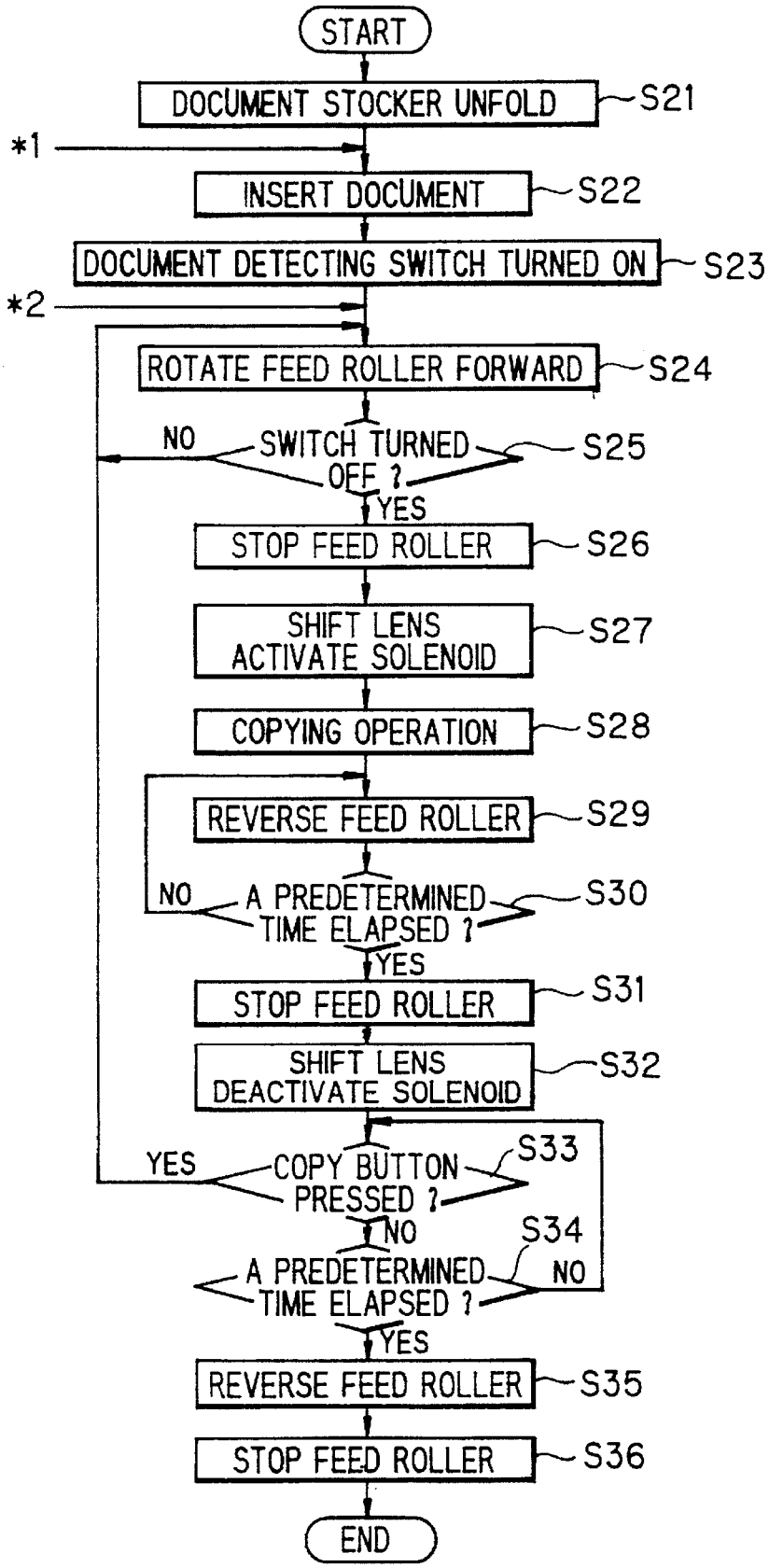
FIG. 11 is a flowchart showing an operation of the invention.

In this case, the reverse drive of the feed roller may and should be added to the stage indicated *2 in the flow shown in flowchart of FIG. 11.

Next, still another variational example of the invention will be described with reference to FIG. 14, FIGS. 15A and 15B and FIG. 11.

Figure 14:
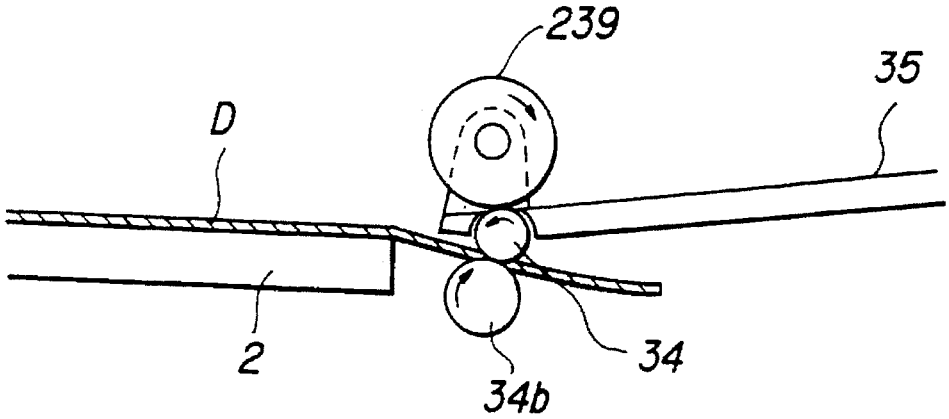
FIG. 14 is a sectional view showing a document discharging means (a third configuration) of the invention.

Referring first to FIG. 14, a document feed roller 239, individually of the feed roller 34*a*, is provided coaxially with the pivot supporting portion of the document stocker 35 so as to come in pressure contact with the feed roller 34*a*. This feed conveying roller 239 is made to drive clockwise (in the direction indicated by an arrow) by means of an unillustrated motor, simultaneously when the document pulled as above in the direction of arrow becomes held between the feed roller 34*a* and the pressing roller 34*b*. This clockwise rotation of the roller 239 reversely rotates the feed roller 34*a*, whereby the previously nipped document is discharged.

Figure 15A:
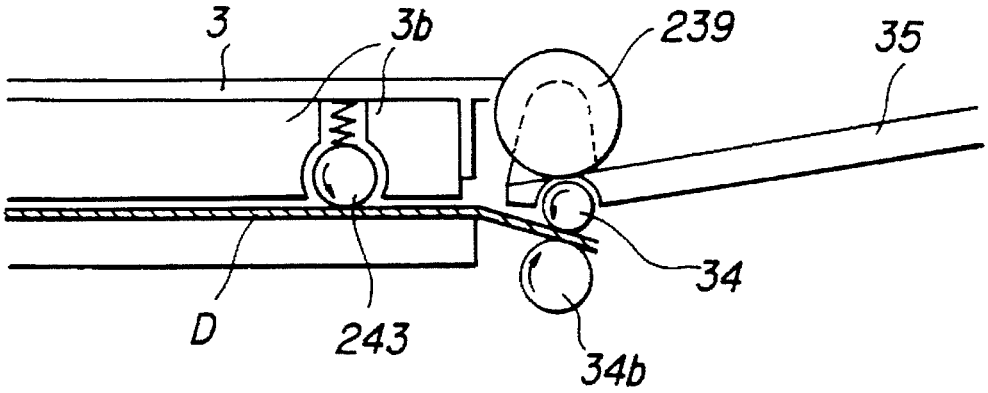
FIG. 15A is a sectional view showing a document discharging means (a fourth configuration) of the invention.
Figure 15B:
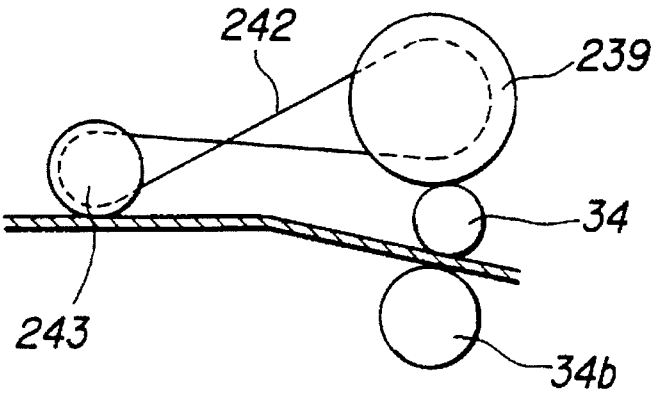
FIG. 15B is a view showing a relation between a feed roller and a roller inside a document cover in the configuration shown in FIG. 15A.

Next, referring to FIGS. 15A and 15B, a discharge roller 243 is provided inside the OC cover. As the above document feed roller 239 rotates clockwise, the discharge roller 243 is driven through a drive belt 242 which is wound around both the rollers 239 and 243. This rotation of the discharge roller 243 slides the document on the table glass toward the nip between the feed roller 34*a* and the pressing roller 34*b*. Then, the document brought between the nip is conveyed by the feed roller 34*a* which is driven through the pressure contact of the roller 239 and thereby discharged to the outside of the OC cover.

As a flow of this case, when the feed roller rotates forward at S24 in the flowchart of FIG. 11, the discharge roller is driven by utilizing the drive of the aforesaid feed roller (as a driving source), whereby the discharge of a left document is effected.

In accordance with the invention, since the document feeder is provided under the original cover and over the control panel and the original cover is formed to press the original cover up as the document stocker is unfolded, it is no more necessary to provide a separate mechanism for moving up and down the document cover. Accordingly, the structure becomes simple and is markedly simplified as compared to the conventional document feeder described above, (that is, necessary components are reduced, for instance, seven rollers, three switches and a solenoid required in the conventional configuration are reduced to two rollers, one switch and no solenoid.) thus making it possible to achieve remarkably reduced cost.

Since the document feeding port is positioned over the top of the control panel, it is possible for the operator to operate the document feeder in the front portion of the copier, whereby the operativity is markedly improved.

The document tray is adapted to also serve as a document stocker and normally is folded over the top of the original cover. Therefore, the document feeder of the invention neither give any feeling of discomfort such as heavy or too bulky as the conventional configuration does, nor there is any difference in handling from the configuration without the document feeder.

Since the document tray is hooked on the copier body as it is unfolded, the tray is secured to the copier body and this fixture enables the document feeder to stably feed documents. Further, this fixing structure clears the operation mode of using the document feeder.

Further, after a document is fed and duplicated, if one more copy for the same document is to be made, the document can automatically be re-inserted as the operator presses the copy button within a predetermined period of time. This feature is able to save the time and labor. Alternatively, if no more copy is needed, the document is automatically discharged. The thus discharged document is placed on the document tray which is also used as the document stocker. That is, when the document tray with the document is folded to its home position or on the top of the original cover, the document can be stored in the document stocker. Accordingly, some documents such as formats and the like which are frequently copied may always be kept in the document stocker, for convenience.

Further, as shown in the above embodiment, in accordance with the invention, if a document has been left behind under the document cover by the previous user, the setting operation of the document feeder by the next user is able to automatically discharge the document left. As a result, it is possible to eliminate the risk of damaging documents.

Moreover, as shown in the above embodiment, in accordance with the invention, as the document feeder is constructed so that the feed roller is reversely rotated before it is rotated forward, it is possible for the document feeder to discharge the left document on the original table in a more assured manner.

Still, as shown in the above embodiment, in accordance with the invention, since an additional (driven) roller is provided below the driving roller (the lower roller as the feed rollers), the document left can be discharged, simultaneously when a next document is fed from the document tray. This feature is able to eliminate time loss.

Furthermore, as shown in the above embodiment, in accordance with the invention, since a separate roller driven by the driving roller of the feed rollers are provided inside the OC cover, it is possible to discharge the document left behind in a further assured manner.

Next, a third embodiment of the invention will be described with reference to drawings. The basic structure of the image forming apparatus to which the third embodiment is applied is the same with that shown in FIGS. 2, 3 and 4, therefore the description will not be repeated.

Figure 16:
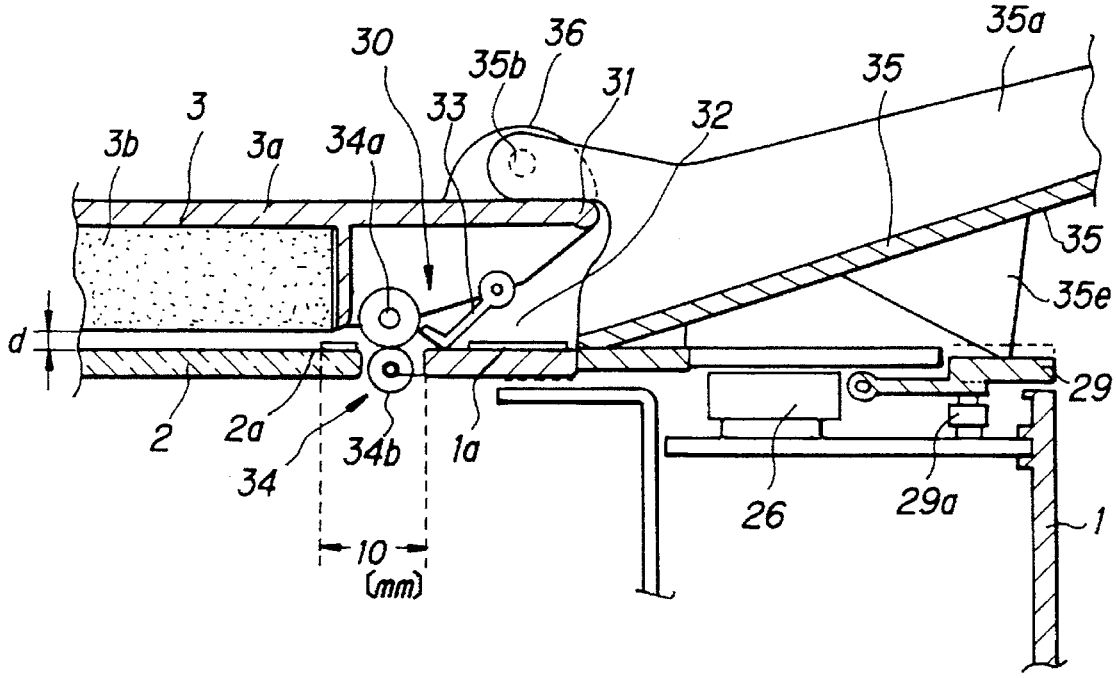
FIG. 16 is a sectional view showing essential components of a configuration of a document feeder equipped in an image forming apparatus of the invention.

As to the structure of the apparatus of the third embodiment of the invention, a configurational example of a lifting mechanism for lifting the original cover 3 up is constructed such that a document stocker 35 formed as a rotatable member on the top of the original cover 3 is rotatably provided and the original cover is raised from the level of the original table 2 when the document stocker 35 is rotated until it is placed over the top outer plate 1*a* of the copier body, as shown in FIG. 16.

To allow this arrangement, the aforementioned document stocker 35 is provided rotatably on pivot supporters 36 provided for the grip portion 31 on the front part of the outer plate of the original cover 3. The document stocker 35 has a bending portion 35*a* disposed on both sides and the rear side to define a space for accommodating documents etc., between the top face of the original cover 3 and itself. Formed on the front side of the stocker 35 is an opening 35*c* from which documents etc., are inserted into the top surface of the original cover 3. A pair of pivots 35*b* are formed in the front part of the bending portion 35*a* on both sides of the stocker 35, so as to allow the document stocker 35 to rotate thereon. The pivots 35*b* are inserted into recesses 36*a* of the pivot supporters 36 provided on the front side of the outer plate 3*a* of the original cover 3.

Particularly, when the outer plate of the original cover 3 is made of a resilient material such as resins etc., it is possible to fit the pivots into the pivots recesses by utilizing the resiliency. More specifically, the pivots 35*b* can be mated with the pivoting recesses 36*a* by warping the bending portion 35 around the pivots 35*b* so that the distance between the pivots 35*b* may become shorter than that of the pivot supporters 36 and aligning pivots with respective recesses and then releasing the deformation. Accordingly, the pivots 36*b* are fitted into respective pivot recesses 36*a* so that the document stocker 35 is rotatably supported relative to the original cover 3.

Thus, the document stocker 35 is pivoted. When the document stocker 35 is placed over the original cover 3, a space is formed by the top face of the original cover 3 and the bending portion 35*a* of the document stocker 35, so as to allow documents and any other necessary articles to be accommodated therein. This document stocker 35 is constructed in such a size as to accommodate originals having a maximum size, especially, maximum width, capable of being copied, as shown in FIG. 2.

Figure 17:
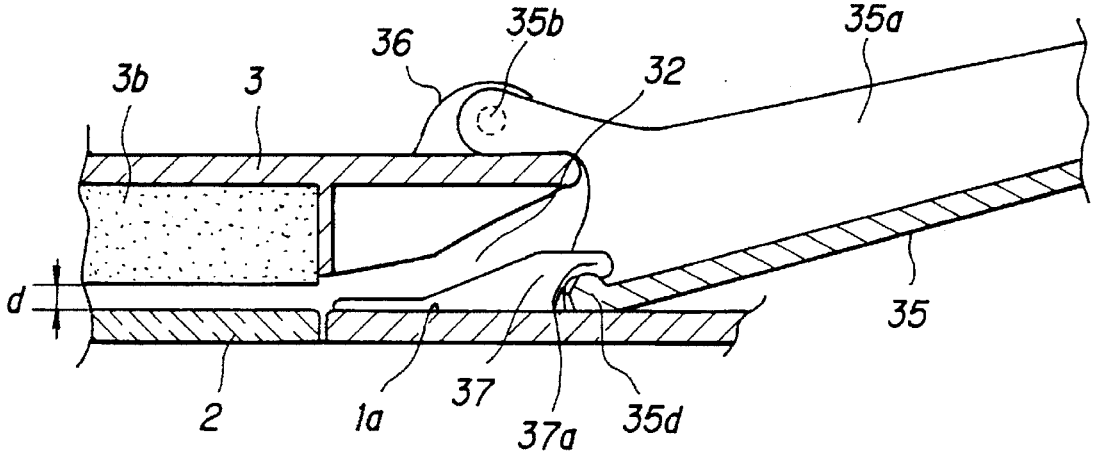
FIG. 17 is a sectional view showing a mechanism and state of lifting an original cover from an original table in a document feeder for conveying a document, equipped in an image forming apparatus of the invention.

In order for the document stocker 35 to lift up the original cover 3 so as to create a gap between the document pressing mat 3*b* and the original table 2, a pair of raising members 37 are provided on the upper portion of the outer plate 1*a* of the copier body side, in corresponding positions to the pivots 35*b*, as shown in FIG. 17. The raising member 37 protrudes in some degree toward the control panel 22 and has a hook portion 37*a* crooked more or less toward the lower part thereof.

In position with the raising members 37, a pair of engaging portion 35*d* are formed on the side of the document stocker 35 to engage with the raising member 37. The engaging portions 35*d* are formed in the vicinity of the front part of the opening 35*c* of the document stocker 35, especially near the pivots 35*b*. Each engaging portion 35*d* has a projected form so as to be fitted into the hook portion 37*a*. The raising members 37 and the engaging portions 35*d* constitute a lifting mechanism.

Accordingly, when the document stocker 35 which is placed over the original cover 3 as shown in FIGS. 2 and 3 is rotated to this side until the document stocker 35 is positioned over the control panel 22, the one end portion of the document stocker 35 abuts the flat surface of the outer plate 1*a* so that the document stocker 35 may not make a further rotation. In this condition, the projected, engaging portions 35*d* of the document stocker 35 are engaged into the hook portions 37*a* of the aforementioned raising members 37.

At this moment, one side of the peripheral edge portions defining the opening 35*c* of the document stoker 35 is supported by the top face of the outer plate 1*a* of the copier body. In this condition, the raising members 37 are engaged with respective engaging portions 35*d*, whereby the original cover 3 is lifted upward by the pivots 35*b*. That is, the grip portion 31 opposed to the pivotable hinge on the rear side of the original cover 3 is raised upward on the hinge of the original cover 3 through the pivots 35*b* as the original stocker 35 is rotated. As a result, a gap 'd' is created between the original table 2 and the document pressing mat 3*b*.

In this arrangement, as a sheet document is inserted along the top surface of the document stocker 35 thus rotated, the inserted document can be conveyed by the feed roller 34*a* and guided through the gap between the original table 2 and the document mat 3*b* onto the original table 2.

The above gap 'd' is determined depending upon a distance between the engaging site of the raising member 37 and the engaging portion 35*d*, and the pivot 35*b*, and upon an angle formed between a line jointed between the pivots 35*b* and the engaging site, and the horizontal plane. That is, it is possible to obtain a desired gap 'd' by setting up these positional relations, properly.

Further, in the present invention, the document stocker 35 is integrally formed with a pressing member 35*e* which presses the cut-in key 29 to make conductive (turn-on) the contact of a switch 29*a* of the cut-in key 29, as shown in FIG. 16. This pressing member 35*e* is formed on the top surface of the document stocker 35 when the stocker is folded on the top of the original cover 3, so that it may be positioned on the underside when the stocker is used as the document feeding guide. Typically, the cut-in key 29 is supported at its one end, for example, and usually urged up in a position indicated by a broken line. As the document stocker 35 is rotated to the position where it is opposed to the control panel 22, the cut-in key 29 is pressed down to a position indicated by a solid line while the document cover 3 is lifted up.

In this invention, when the contact of the switch 29*a* provided in position with the key 29 is made conductive (turned on) as the cut-in key 29 is pressed down, the cut-in mode is set up and the copy mode or the copying condition for the previous operation before the key 29 is pressed can temporarily be shunted and stored in the memory. Copying conditions, for example, setup copy magnification, setup copy quantity, the number of finished copies, the number of copies to be made, setup copy contrast etc., are stored in the memory and at the same time, the standard utility mode, or identical magnification, setup copy quantity set at '1', and standard copy contrast, are set up.

When the pressed state of the cut-in key 29 is released or the contact of the switch 29*a* is made non-conductive (or turned off), the cut-in mode is disengaged and thereby the copy mode based on the shunted and memorized copying conditions is loaded, so that the mode before the cut-in is made active.

Referring next to a flowchart shown in FIG. 18, the operation of the copier and the document feeder 30 will be described. FIGS. 2 and 3 show a state where the original cover 3 is closed with the document stocker 35 positioned over the original cover 3. From this setting, the document stocker 35 is rotated to this side to be opened. By this operation, the hook portion 37*a* of the raising member 37 meshes the engaging member 35*d*, as shown in FIGS. 16 and 17, so that the document stocker 35 is lifted upward, creating the gap 'd' between the document pressing mat 3*b* and the original table 2. In the above setting, when a document D is inserted along the upper surface of the document stocker 35 from the document feeding port 32, the document D raises the detecting lever 33, to thereby turn the document detecting switch on (Step S41).

At the time of inserting the document, if, for example the left edge of the original table 2 in FIG. 2 is assumed to be a reference position for the placement of the document, the left side of the bending portion 35*a* of the document stocker 35 is adapted to coincide to the reference position, whereby it is possible to use the bending portion 35*a* to guide the front part of the document. By this arrangement, it is possible to deliver the document to the original table 2 in place with its front side aligned with the reference position.

As the document detecting switch is activated by the inserted document through the operation of the detecting lever 33, the feed roller 34*a* starts to rotate in the forward direction or in the document feeding direction (in the clockwise direction in FIG. 16) (Step S42), the document D is fed into a gap 'd' between the document pressing mat 3*b* and the original glass table 2. In this case, the opposed face of the document pressing mat 3*b* to the original table 2 serves as a document guide. The gap 'd' is preferably 0.1 mm or more by considering that a typical paper sheet is about 0.08 mm thick. The clearance 'd' can easily be adjusted as stated before.

Thereafter, when the rear end of the document D goes through the detecting lever 33 and the document detecting switch turns off (Step S43), the feed roller unit 34 stops turning (Step S44) while the rear end of the document D is kept nipped by the feed roller unit 34.

In this way, as the document D is automatically fed onto the document table 2, the copier starts to perform the same copying operation as will be effected when the copy button 23 is pressed, whereby the copier effects reproducing procedures from the exposure to the discharge of copy paper (Step S46). In this case, the copying operation is carried out with the rear end of the document D nipped by the feed roller unit 34. Therefore, the placement of the document differs by, for example, about 10 mm, as shown in FIG. 16, from where the usual operation is done without using the document feeder 30. Since the rear end of the document is kept nipped by the feed roller unit 34, the difference is the distance between the nipped edge and one reference side of the original table 2. To cancel this difference, in this embodiment, the lens 4*e* in the optical system is shifted from a reference position so that the center of the document D may coincide with the that of the copy sheet P.

Specifically, the copier is constructed so that activation of the document switch may start the same copying operation as is effected when the copy button 23 is pressed. Accordingly, with no pressing of the copying button 23, insertion of a document turns the original detecting switch on, to thereby start the copying operation. Before the activation of the copying operation, the lens 4*e* is shifted by about 5 mm by means of an unillustrated solenoid or motor for lens-shifting, so that the nipped document D may be image-formed on the photoreceptor 5 with the focused image of the edge shifted by 10 mm. Accordingly, it is possible to make the focused image on the photoreceptor coincide with the feed reference position of the copy sheet delivered as usual (Step S45). For this purpose, the lens 4*e* is provided so as to be able to move in the direction perpendicular to the optical axis (in the forward and rearward directions in FIG. 16). When copying operation is done by automatic document handling, the copier is so set up that the lens 4*e* is shifted about 5 mm toward the front side in FIG. 2, or rightward in FIG. 16 or 17.

In this case, the undersurface of the supporting frame of the original table 2, in particular, the region around the nipped portion of the document where the light is illuminated by the optical system should preferably be white, since the reflected light from this area is projected on the photoreceptor 5. If this area has a dark color, toner would be adhered onto the corresponding area and transferred to the copy sheet, resulting in formation of a black strip of about 10 mm in width.

In this condition, copying operation is effected in Step S46. After the completion of the process, the feed roller unit 34 is turned in the reverse direction by the driving motor (Step S47), the document D is delivered out toward the document feeding port 32. This discharge is performed by previously memorizing the rotating time of the feed roller unit 34 when the document D is inserted and measuring a setup time which is a little shorter (by a time equivalent to about 10 mm in feed distance) than the memorized time (Step S48) and stopping the reverse movement of the feed roller unit 34 after the passage of the thus setup time (Step S49). After the document discharging operation, the solenoid for shifting lens 4*e* is deactivated at Step S50 in order to return the focusing lens 4*e* to the original position. Thereby, the lens 4*e* returns to the originally reference position so that the reference edge 2*a* of the document may be image-formed in the specified position on the photoreceptor 5.

Accordingly, the document D stops at a position where the end of the document D is nipped in some degree by the feed roller unit 34. In this condition, if another copy is wanted and the copy button is pressed (S51) within a predetermined period, for example, 2 seconds (S52) after the feed rollers stopped, the feed roller unit 34 starts turning in the forward direction (S42) and the system reenters copying operation.

Thus, it is possible to take a multiple number of copies. When the passage of the predetermined time is checked at Step S52, the feed roller 34*a* is again reversed (S53) so that the document D is discharged to the document stocker 35. Then, the rotation of the feed roller 34*a* is stopped. It is noted that if the number of copies for a document is specified previously, it is possible to easily obtain a required number of copies in a single operation.

As has been described, duplication of a single document is performed using the document feeder 30. If two or more documents are to be copied, the operator should put the finished document onto the top flat face of the original cover 3 and insert a next sheet document into the document feeding port 32 to effect a similar copying operation to thereby obtain desired copies.

In accordance with this embodiment, the document is fed in a direction perpendicular to the direction in which copy sheets are conveyed. Accordingly, since copying is effected with one side edge of the document nipped, the centers of the copy sheet and the document will not coincide with one another. To avoid this situation, the focusing lens is moved in the direction perpendicular to the optical axis of the lens, whereby the centers of the document and the copy sheet are made coincident.

Nevertheless, it is also possible to convey the document in the same direction as the copy sheet is conveyed. That is, for example, the original cover 3 is hinged on the right side in FIG. 2 while a document feeding port may be formed on the opposite side to the hinged portion. The other components may be configurated in the same manner as described above. In this case, the document is exposed to light with the rear end of the document nipped 10 mm, for example, the front end of the image formed on the photoreceptor is positioned different by 10 mm from the front end of the copy sheet conveyed. To cancel this discrepancy can be easily done by effecting control of driving so as to make the timing of delivering the copy sheet, earlier by a time equivalent to about 10 mm in feed distance.

In the configurations described above in which the image of the document is directly projected to the photoreceptor, the deviation of centers between the document and the copy sheet or the difference of the front end of the sheet from that of the image formed is unavoidable. This can be dealt with by using a digital image forming apparatus in which the image of a document placed is picked up digitally so that the picked up data is written onto the photoreceptor with laser beams. In such an image forming apparatus, the aforementioned center difference between the document and the copy sheet or the positional deviation between the copy sheet and the formed image can be modified or corrected when illumination of laser beams is to be done. That is, partial image area which is of the original but is not placed on the original table 2 is assumed to be plain area, whereby the total image containing the plain area may and should be written in on the photoreceptor 5 by laser illumination. To pick up an image digitally, a typical process is effected as follows: That is, a CCD or the like should be disposed after the focusing lens 4*e*. The picked up image data from the document by the CCD is A/D converted to be stored. Then, the laser beams modulated based on the stored digital image data are illuminated on the photoreceptor 5, whereby a static latent image corresponding to the image of the document can be created with dots.

As described heretofore, the document feeder 30 of this embodiment can be constructed by the simple means, so that it is possible to markedly contribute to reducing the cost. In the above description, the document stocker 35 for creating a gap 'd' between the original cover 3 and the original table 2 is configurated as holding documents etc., but this is not a must but a mere rotational member can be provided and used as a document guide, in place of the document stocker 35. However, since, in the above embodiment, the document stocker 35 has both functions, it is advantageous that the member can be used as a storage if the document feeder is not used.

Now, in the invention, as the document stocker 35 is rotated so that the document stocker 35 may be used as the document feeding guide, the pressing member 35*e* presses the cut-in key 29 down to set up the cut-in mode. In this case, suppose that a copying operation has been effected in a copy mode in which image forming conditions such as a copy magnification, a copy contrast etc., have been specified by the manual input, while documents being manually placed and replaced on the original table 2 by opening and closing the original cover 3. At that moment, in the case that some or several sheet documents are to be copied as stated above in the interval of replacement of documents and when the cut-in key 29 is turned on, the current copy mode in which copying conditions have been set up is not cleared but is temporarily shunted and stored in the memory. Then, the copier is set into the standard copy mode or the frequently used copy mode in which identical magnification, standard copy contrast and copy quantity set at '1', are set up.

Figure 19:
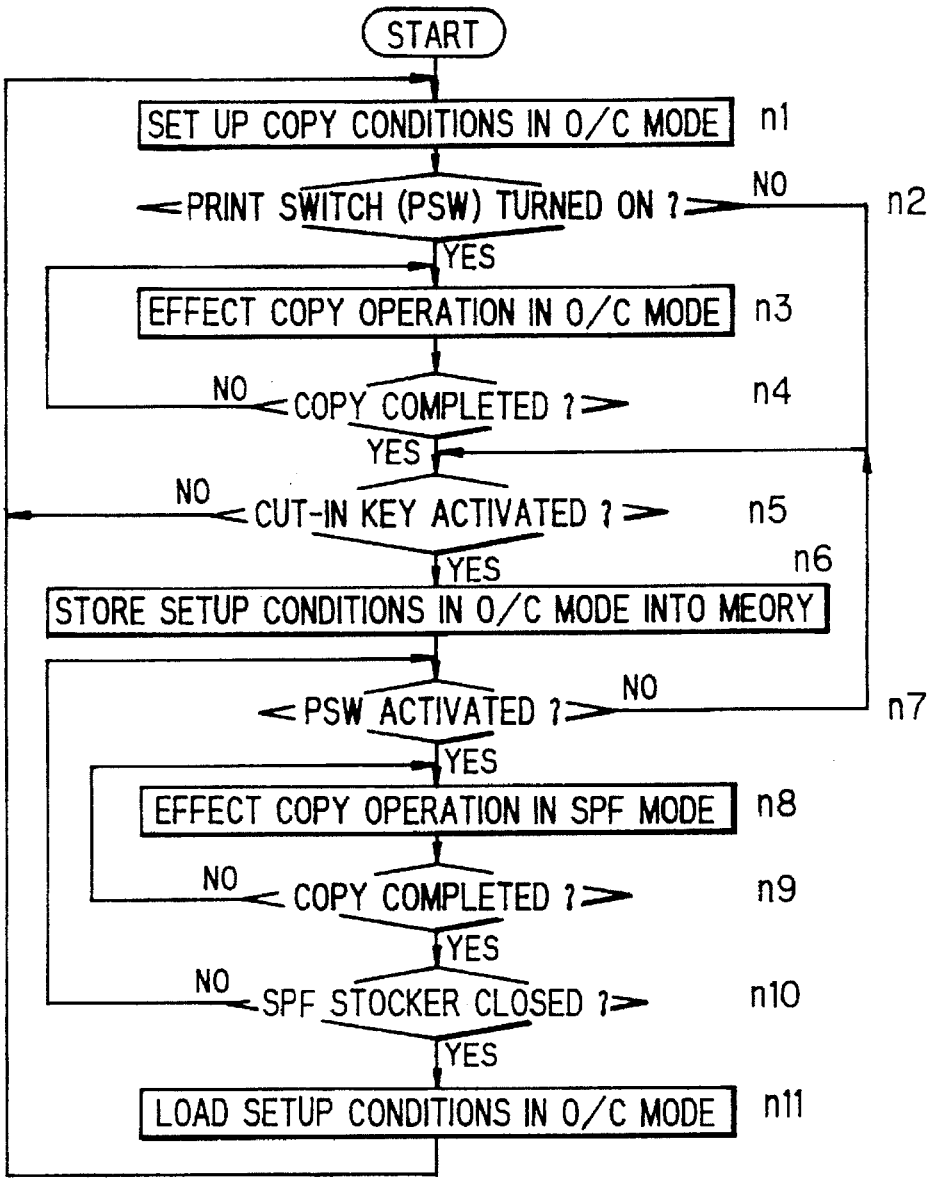
FIG. 19 is a flowchart showing a controlling operation in association with the controlling of cut-in operation when a document feeder of the invention is used.

FIG. 19 is a flowchart of the operation control when the cut-in key 29 is activated. Now, the operation of the copier will be described in detail with reference to the flowchart. In the original cover using mode (to be referred to as the OC mode), while the document stocker 35 is folded over the original cover 3, copying operation is effected by opening and closing the original cover 3 to manually replace the document on the original table 2. In this case, the copying conditions are inputted setup by the operator at n1. This setup input includes, for example, copy magnification, copy contrast, copy quantity and other necessary setup conditions. When a copying operation is to be made in the copy mode thus designated, the print switch 23 is operated (n2). In response with this operation, a copying operation in the setup mode is started for the original placed on the original table 2.

When the copying operation in OC mode in which the copying conditions have been thus set up is complete (n4), a judgment is made at n5 on whether the document stocker 35 is rotated so that the document feeder 30 using the stocker 35 is activated, or whether the switch is activated by the aforementioned cut-in key 29. That is, as the document stocker 35 is rotated so as to set up the SPF mode (single paper feed mode) in which the document stocker 35 is utilized as the document feeding guide, the pressing member 35*e* formed on the document stocker 35 presses the cut-in key 29. This pressing activates the contact of the switch 29*a* (n5) to set up the cut-in mode. At that moment, the aforementioned copy mode of the copying conditions designated at n1 is temporarily shunted and stored in the memory means (n6). For example, copying conditions such as copy magnification, copy contrast, setup copy quantity, the number of finished copies, the number of copies to be made, etc., are stored in the memory.

Figure 18:
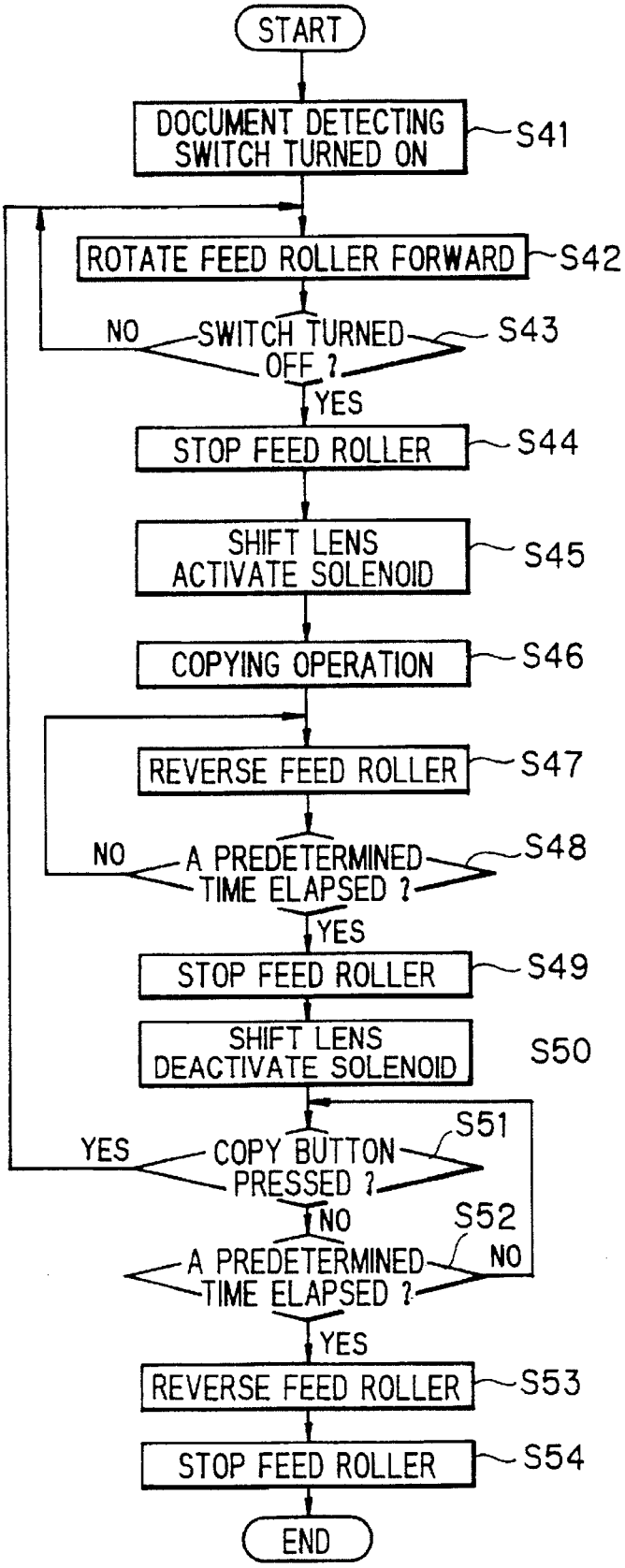
FIG. 18 is a flowchart showing a controlling operation in association with the operation control and image forming of a document feeder of the invention.

Thereafter, as the print switch 23 is pressed (n7), the copying operation using the document feeder 30 as shown in FIG. 18 is started (n8). The control of the operation is effected as shown in FIG. 18. That is, for example, as a document is inserted along the surface of the document stocker 35, the detecting switch is turned on. Then, the copier starts to perform the same copying operation as will be effected when the print switch 23 is pressed.

When the above copying operation of the document is complete (n9), it is checked at n10 whether the SPF mode utilizing the document feeder 30 is to be canceled. That is, as the document stocker 35 is turned so as to be placed on the original cover 3, the pressing member 35*e* is released from the cut-in key 29, whereby the switch 29*a* is turned off. Thereby, the cut-in mode or the SPF mode utilizing the document feeder 30 is canceled (n11). At the same time, the stored mode at n6 in which documents are to manually be placed on the original table 2 is recovered and the copying conditions are loaded (n11). Then the operation is returned to n1 where the loaded conditions are set up. Therefore, a simple operation of the print switch 23 resumes the copying operation previously set up in the OC mode in which documents are to manually be replaced.

Thus, in the case that the cut-in copying operation of sheet documents are to be done at the interval of replacing a document onto the original table 2, a mere unfolding of the document stocker 35 for allowing itself to be used as the document feeding guide, operates the cut-in key 29. Accordingly, it is possible to avoid miscopy due to the forgetfulness of the operator to operate the cut-in key 29. Further, since the previous copying conditions in the OC mode in which documents are manually replaced are temporarily shunted and stored in the memory, the temporarily shunted and memorized copying conditions in the OC mode are loaded and set up automatically at the stage when the SPF copy mode using the document feeder 30 is complete. Accordingly, there is no more need for setting up the copying conditions, repeatedly.

In the embodiment of the invention, the original cover 3 is adapted to rise from the original table 2 by the lifting mechanism in link with the rotation of the document stocker 35 when the stocker is set to be used as the document guide. However, the invention should not be limited to this configuration. That is, it also possible to make the same operation by a lifting mechanism in which the original cover 3 is lifted up when a document is inserted.

Figure 20:
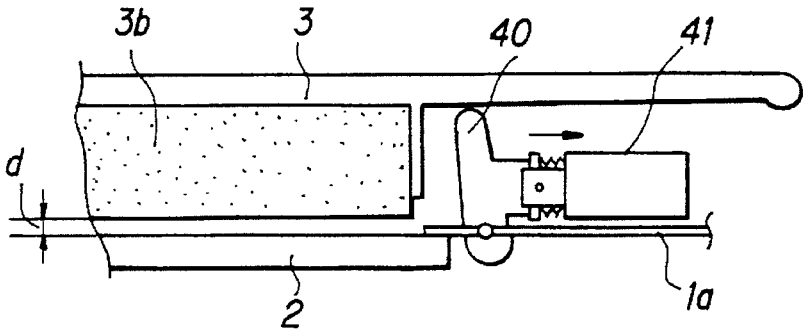
FIG. 20 is a sectional view showing another specific example in which an original cover constituting a document feeder of the invention is raised from an original table.

FIG. 20 shows an example. The means include: a moving piece 40 disposed in a position outside the document inserting region for the maximum-width document, for lifting the original cover 3 up; and a solenoid 41 disposed between the handgrip of the original cover 3 and the outer top face 1*a* of the copier body, for operating the moving piece 40. The moving piece 40 for lifting is rotatably supported by the outer plate 1*a* and the opposite part abuts the grip portion of the original cover 3 while the central portion is jointed to the solenoid 41.

When the solenoid 41 is not energized or not supplied with electric power, the moving piece 40 stays a little inclined in the counterclockwise direction. In this condition, no clearance 'd' is created between the original table 2 and the document mat 3*b*. That is, the document pressing mat 3*b* is in close contact with the original table 2. As the solenoid 41 is energized by electric power, the moving piece 40 moves to a position shown in FIG. 20 so that the original cover 3 is raised to create a gap 'd' between the document mat 3*b* and the original table 2.

In the above arrangement, in the case where the document stocker 35 is rotated to be used as the original guide; if a document is inserted, the detecting switch is activated through the detecting lever 33. Accordingly, the solenoid 41 is energized to rotate the moving piece 40, whereby the original cover 3 can be raised. In this condition, the feed roller 34*a* is activated to convey the sheet document to the original table 2.

This operation will be explained using the above-described flowchart of operation control, shown in FIG. 18.

As a document is detected at S41, this activates the solenoid 41 so as to lift up the original cover 3 from the original table 2 by a gap 'd', as shown in FIG. 20. Then the steps after S42 are effected. When the operation reaches Step S44, the feed roller is stopped. In this situation or in a state where the rear end of the document stopped is nipped by feed roller 34*a*, the lens is shifted at S45 and at the same time, the solenoid 41 is deactivated.

The deactivation causes the original cover 3 to press down the fed document with its rear end nipped so that the copied surface of the document may be brought into close contact with the original table 2. Then, copying operation is effected at S46. As the copying operation is complete, the feed roller 34*a* is reversely rotated at S47 in order to discharge the document. Before this rotation, the solenoid 41 should be energized to space the document pressing mat 3*b* from the original table 2. As the above steps are successively repeated, it is possible to effect copying operation for a desired number of original documents, by using the document feeder 30. Since, in the document feeder 30 of the invention, the original cover 3 presses the document inserted against the original table, some wrinkles and irregularity of the sheet document, if any, can be smoothed, whereby it is possible to create qualified copies free from shadows due to the wrinkles and irregularity.

Here, although the original cover 3 is lifted up before the reverse rotation of the feed roller 34*a* to discharge the document, if the conveying force on the document by the feed roller is so strong that the document even pressed by the original cover 3 can be discharged, only the reverse rotation of the feed roller at S47 may be effected enough, without energizing the solenoid 41.

Here, the cut-in key 29 is operated by way of the pressing member 35*e* of the document stocker 35. At that moment, if the cut-in key 29 is operated in the OC mode in which documents are to be replaced manually, the current mode is maintained until the copying operation is complete. When the document is removed by opening the original cover 3 after the completion of the copying operation and at the same time if the cut-in key 29 is turned on, the cut-in mode or the copying mode utilizing the document feeder 30 is activated. This method is to prevent the cut-in mode from being set up in the course of copying or to prevent the current copy mode from being canceled during copying operation. This is done as shown in FIG. 19 by checking the operated state of the cut-in key 29 at n5 after a series of copying operations for one document is complete. As a result, if the cut-in key 29 is operated in the course of copying, the signal is made invalid.

In contrast to the situation described above, when the document feeder 30 is engaged in the SPF copy mode, the switch 29*a* of the cut-in key 29 is turned off, this state is made invalid and the operated state of the cut-in key 29 is checked after the copying operation of the document is complete. That is, the deactivated state of the cut-in key 29 is checked at n9 after the copying operation is complete and it is determined, based on the result, whether the mode is to be canceled. Accordingly, even if the document stocker 35 is raised accidentally during the copying operation using the document feeder 30, the mode is kept without being canceled, whereby it is possible to avoid miscopy due to the change in copying conditions.

In this embodiment, the cut-in key 29 is adapted to operate by means of the document stocker 35. That is, the pressing member 35*e* of the document stocker 35 presses down the cut-in key 29 by the weight of the document stocker 35. Alternatively, it is also possible to configure the device such that the cut-in key 29 may be pressed down only when a document or some documents are placed on the document stocker 35. That is, since the cut-in mode is set up when a document or some documents to be inserted are placed on the document stocker 35, it is possible to effect shunting and storing of the copy mode in a more assured manner. Specifically, only when the document stocker 35 is used and a document or some documents are placed thereon, the copying conditions in the OC mode in which documents are replaced manually, are stored in the memory, whereby it is possible to prevent indiscriminate shunt and memory.

As has been described, in accordance with the image forming apparatus of the invention, since a simple document feeder is provided which includes a feeding means disposed on one side of the original table for delivering documents into between the closed original cover and the original table, it is possible to reduce the cost as of a copier with a document feeder.

In the above case, when the document feeder for feeding documents to the original table is used, it is possible to reserve the image forming conditions for a different mode in the image forming apparatus from those in the document feeder mode while the image forming in the document feeder mode can be set up in the standard form. Further, when the use in the document feeder mode is completed, the state for previous setup conditions of the image forming is set up again. As a result, it is possible to save time and labor for setting up the conditions as well as to eliminate the risk of yielding unwanted copy.

Still more, when a document is delivered, the original cover is lifted to allow the document to be fed and then the raised state is released after the document is positioned in place. Accordingly, it is possible to press the document onto the original table making close contact, whereby risk of formation of shadows due to wrinkles and irregularity in the copied image is eliminated.

Next, a fourth embodiment of the invention will be described with reference to drawings. The basic structure of the image forming apparatus to which the fourth embodiment is applied is the same with that shown in FIGS. 2, 3 and 4, therefore the repeated description is omitted and only elemental, additional points will be explained.

Figure 21:
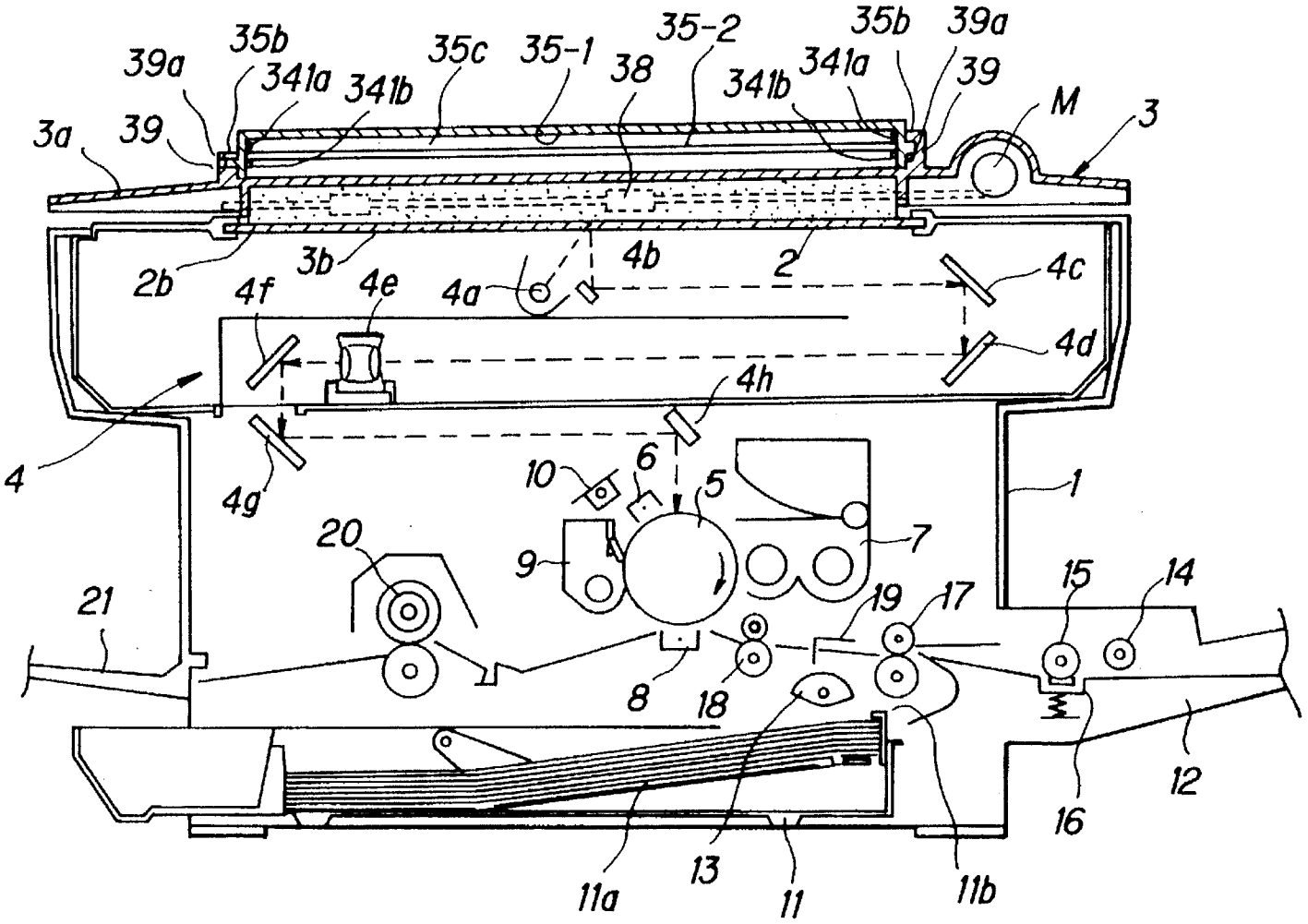
FIG. 21 is a schematic sectional view showing an inside structure of a copier as an image forming apparatus equipped with a document feeder in accordance with the invention.
Figure 22:
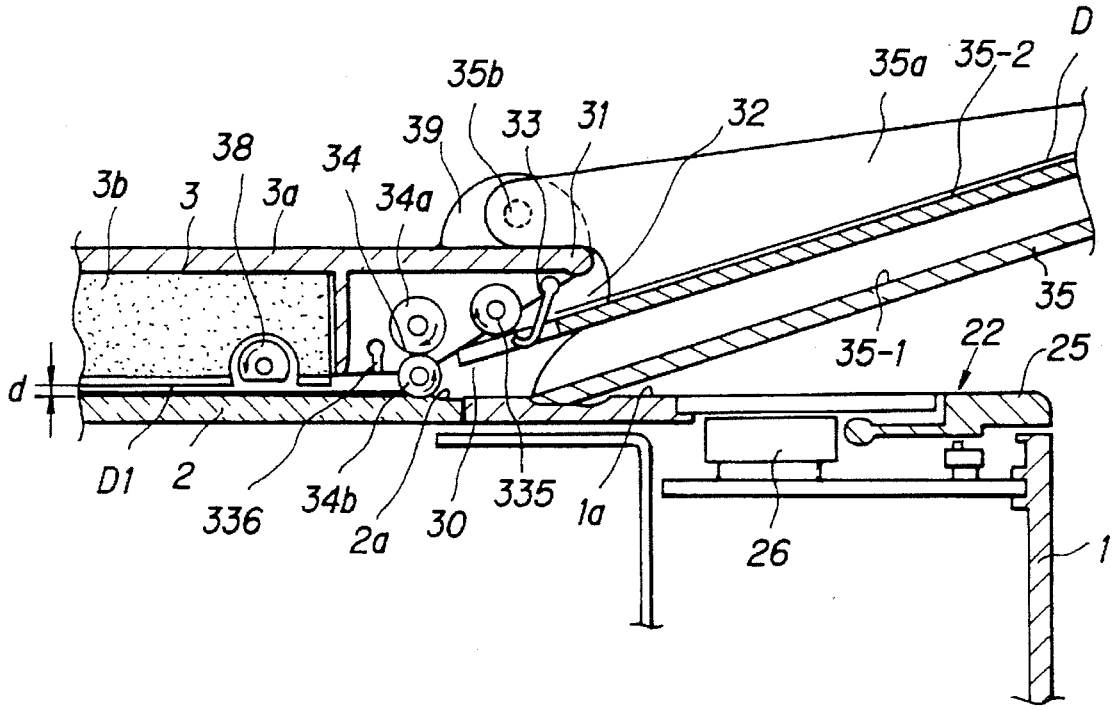
FIG. 22 is a sectional view showing essential components of a configuration of a document feeder equipped in an image forming apparatus of the invention.

Referring first to FIG. 21, a left-side end of the original table 2 constitutes a reference edge 2*b* as to be an exposure starting position in the scan direction of the document. As shown in FIG. 22, there is a reference position 2*a* on the front edge on the front side in FIG. 21. This reference position 2*a* is perpendicular to the reference edge 2*b*. Therefore, when a document is placed, one of its four corners is positioned at the intersection between the reference edge 2*b* and the reference position 2*a* and the two sides forming the corner are aligned to the reference edge 2*b* and reference position 2*a*, respectively. Particularly, since documents are discharged from the reference position 2*a*, it is unpreferable that the part is projected from the level of the original table 2. Therefore, the reference position 2*a* is formed on the original table by, for example, printing of white ink or the like.

Next, the document feeder of the invention will be explained with reference to FIGS. 22 and 23. The document feeder includes the original cover 3, a part of the original cover and original feed rollers etc., disposed between the control panel 22 and the original cover 3. For example, a document feeder 30 comprises: a document feeding port 32 through which original documents are inserted; a document detecting lever 33 which is pressed up by the document inserted to turn on a document detecting switch; and feed roller unit 34 for feeding the inserted document onto the original table glass 2.

The feed roller unit 34 are composed of a feed (driving) roller 34*a* disposed above for driving and a roller 34*b* below. As shown in FIG. 22, this feed roller unit 34 is arranged such that the driven roller 34*b* is pressed against one reference position 2*a* on the original table 2 when the original cover 3 is placed over the original table 2. A pull-in roller 335 for pulling an inserted document into the appliance is provided on the inserting side of the feed roller unit 34. This pull-in roller 335 and the driving roller 34*a* are driven by the same driving source or a driver motor M disposed on the side of the original cover 3, as shown in FIG. 21. That is, these two rollers are linked with the driving shaft of the driver motor M through separate transmission means including gears and clutches etc., so that they are controlled to rotate independently of each other.

A detecting switch as well as a detecting lever 33 for detecting an inserted document into the feed area toward the feed roller 34*a* is disposed also on the side of original cover 3. The detecting lever 33 is positioned in opposition to an insert-tray 35-2 of a document stocker 35 (which will be detailed later) when the document stocker 35 is unfolded. As a document is inserted and the lever 33 is rotated thereby in the clockwise direction in the figure, the lever 33 detects the insert of the document and turns the switch on. Specifically, a corresponding portion of the front end part of the insert-tray 35-2 to the detecting lever 33 is cut out so that the detecting lever 33 may fit in the cutout portion. Therefore, as a document is inserted, the lever is lifted up by the document to rotate clockwise, whereby the contact of the document detecting switch is activated. Thus the document is detected.

Provided on the downstream side in the document conveyed direction is another detecting lever 336 to detect the fed document. Particularly, when the detecting lever 336 is operated (the document detecting switch is turned off) after the passage of the rear end of the document, a semicircular roller 38 (which will be detailed hereinbelow) is driven so as to introduce the rear end of the document into a nip between the driven roller 34*b* of the aforementioned feed roller unit 34 and the original table 2.

The rotatable semicircular roller 38 is provided for the document cover 3 near the reference position 2*a* of the document table 2. The semicircular roller 38 is placed inside a depressed portion formed in the original mat 3*b* such that the circumferential face of the semicircle may come in contact with the original table 2 to convey the document and such that the chord of the roller may be spaced by a certain gap from the original table 2 to form a non-contacted surface. This semicircular roller 38, like the pull-in roller 335 and the feed roller 34*a*, is linked with the rotary shaft of the aforementioned driver motor M through a transmission means such as of gears and clutches etc. The semicircular roller 38 is controlled so that the chord portion thereof constantly be opposed to the surface of the original table 2 when it is stopped. Accordingly, the semicircular roller 38 is always rotated by a predetermined integer number of rotations.

Meanwhile, a document pressing mat 3b is provided on the inner side of the original cover and usually comes in close contact with the surface of the original table 2, by the self-weight. Hence, even if the document being inserted is conveyed by the feed roller unit 34, the document can not be inserted into between the document pressing mat 3b and the original table 2, but will be stopped and become stuck. Accordingly, it is necessary to lift the original cover 3 up to create such a gap between the original table 2 and the document pressing mat 3b as to allow the document to pass therethrough.

As a configuration of the lifting mechanism for lifting the original cover 3 up, a document stocker 35 is rotatably provided on pivot supporters 39 provided for the grip portion 31 on the front part of the outer plate of the original cover 3. When the document stocker 35 is unfolded, the mat 3b of the original cover 3 is raised by a certain distance from the original table 2.

Therefore, the document stocker 35 has a bending portion 35a disposed on both sides and the rear side to define a space for accommodating documents etc., between the top face of the original cover 3 and itself. Formed on the front side of the stocker 35 is an opening 35c from which documents etc., are inserted into the top surface of the original cover 3. A pair of pivots 35b are formed in the front part of the bending portion 35a on both sides of the stocker 35, so as to allow the document stocker 35 to rotate thereon. The pivots 35b are inserted into recesses 39a of the pivot supporters 39 provided on the front side of the outer plate 3a of the original cover 3. Particularly, when the outer plate of the original cover 3 is made of a resilient material such as resins etc., it is possible to fit the pivots into the pivots recesses by utilizing the resiliency. More specifically, the pivots 35b can be mated with the pivoting recesses 39a by warping the bending portion 35 around the pivots 35b so that the distance between the pivots 35b may become shorter than that of the pivot supporters 39 and aligning pivots with respective recesses and then releasing the deformation. Accordingly, the pivots 39b are fitted into respective pivot recesses 39a so that the document stocker 35 is rotatably supported relative to the original cover 3.

Thus, the document stocker 35 is pivoted. When the document stocker 35 is placed over the original cover 3, a space is formed by the top face of the original cover 3 and the bending portion 35a of the document stocker 35, so as to allow documents and any other necessary articles to be accommodated therein. This document stocker 35 is constructed in such a size as to accommodate originals having a maximum size, especially, maximum width, capable of being copied, as shown in FIG. 21.

Figure 23:
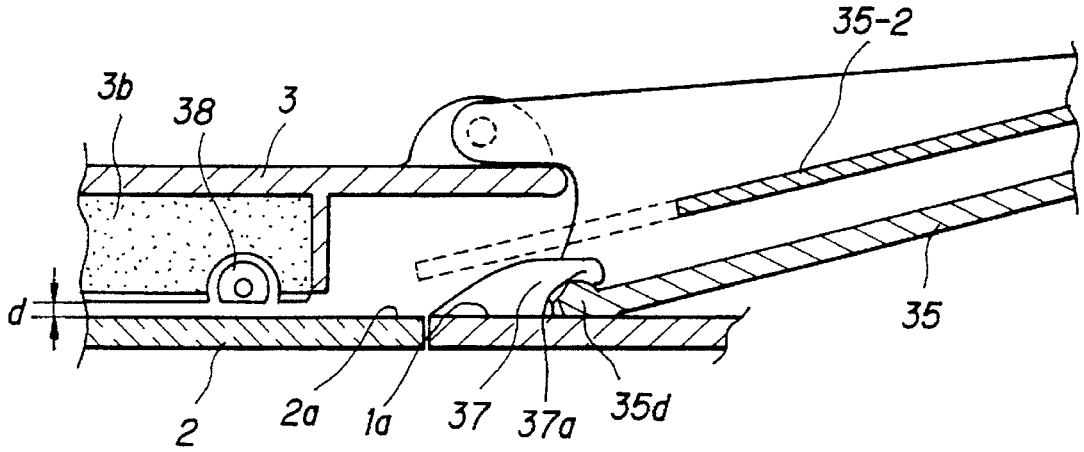
FIG. 23 is a sectional view showing a mechanism and state of lifting an original cover from an original table in a document feeder for conveying a document, equipped in an image forming apparatus of the invention.

In order for the document stocker 35 to lift up the original cover 3 so as to create a gap between the document pressing mat 3b and the original table 2, a pair of raising members 37 are provided on the upper portion of the outer plate 1a of the copier body side, in corresponding positions to the pivots 35b, as shown in FIG. 23. The raising member 37 protrudes in some degree toward the control panel 22 and has a hook portion 37a crooked more or less in the lower part thereof.

In position with the raising members 37, a pair of engaging portion 35d are formed on the side of the document stocker 35 to engage with the raising member 37. The engaging portions 35d are formed in the vicinity of the front part of the opening 35c of the document stocker 35, especially near the pivots 35b. Each engaging portion 35d has a projected form so as to be fitted into the hook portion 37a. The raising members 37 and the engaging portions 35d constitute a lifting mechanism.

Figure 24:
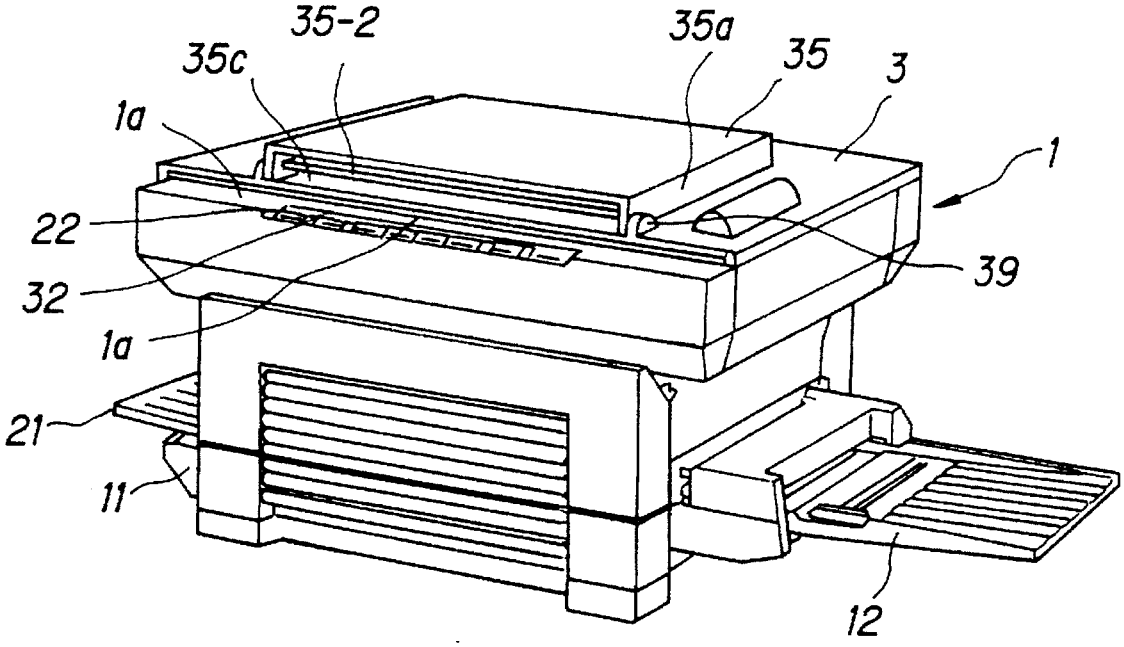
FIG. 24 is a perspective view showing an appearance of a copier as an image forming apparatus including a document feeder of the invention.

Accordingly, when the document stocker 35 which is placed over the original cover 3 (in its folded state) as shown in FIGS. 21 and 24 is rotated to this side until the document stocker 35 is positioned over the control panel 22 (in its unfolded state), the one end portion of the document stocker 35 abuts the flat surface of the outer plate 1a so that the document stocker 35 may not make a further rotation. In this condition, the projected, engaging portions 35d of the document stocker 35 are engaged into the aforementioned raising members 37. At this moment, one side of the peripheral edge portions defining the opening 35c of the document stoker 35 is supported by the top face of the outer plate 1a of the copier body. In this condition, the raising members 37 are engaged with respective engaging portions 35d, whereby the original cover 3 is lifted upward by the pivots 35b. That is, the grip portion 31 opposed to the pivotable hinge on the rear side of the original cover 3 is raised upward on the hinge of the original cover 3 through the pivots 35b as the original stocker 35 is rotated. As a result, a gap 'd' is created between the original table 2 and the document pressing mat 3b.

In this arrangement, as a sheet document is inserted along the top surface of the document stocker 35 thus rotated, the inserted document can be conveyed by the feed roller 34a and guided through the gap between the original table 2 and the document mat 3b onto the original table 2.

The above gap 'd' is determined depending upon a distance between the engaging site of the raising member 37 and the engaging portion 35c, and the pivot 35b, and upon an angle formed between a line jointed between the pivots 35b and the engaging site, and the horizontal plane. That is, it is possible to obtain a desired gap 'd' by setting up these positional relations, properly.

Meanwhile, in the present invention, in order to guide the inserted document to the feed roller unit 34, the aforementioned document stocker 35 is used as the document placing tray so that the document may be guided. Further, the document stocker 35 is also used as a discharge tray for the purpose of parting copy-finished documents from unfinished documents to be inserted.

To do this, the document stocker 35 is further provided with a document-insert tray 35-2. The rear face of the document stocker 35 or the face which is opposed to the original cover 3 when the document stocker 35 is placed over the original cover 3 is utilized as a document discharge stocker 35-1.

Figure 25:
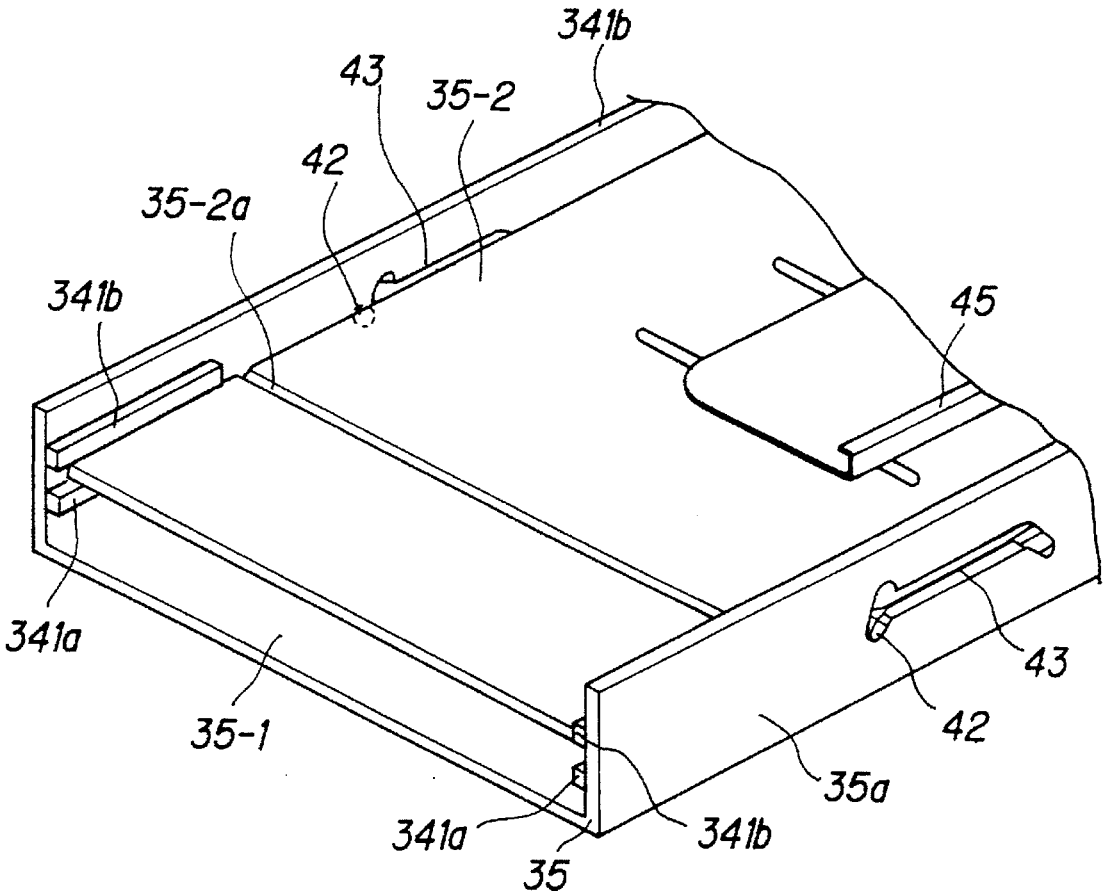
FIG. 25 is a perspective view showing a configurational example of the invention in which insert and discharge trays are formed in a commonly used document stocker in order to separate discharged documents from inserted documents.

The document-insert tray 35-2 is provided to be slidable relative to the document stocker 35, as shown in FIGS. 21 and 25. For this purpose, the bending portion 35a of the document stocker 35 has upper and lower guides 341a and 341b for slidably holding both side-parts of the insert tray 35-2, and both side-parts of the tray 35-2 is inserted in the gap between the upper and lower guides 341a and 341b. Here, the upper and lower positions referred to are positions when the document stocker is placed in the state shown in FIG. 21. That is, if the document stocker 35 is unfolded as shown in FIG. 22, the vertical relation becomes inverted. Each of the lower guides 341b is not provided in the whole length of the bending portion 35a but is formed partially on the rear side of the document stocker. As the insert tray 35-2 is pushed toward the document inserting direction, the rear end of the insert tray 35-2 comes off the lower guide 341b so that the rear part becomes able to bend upward rotatably on a groove 35-2a, in FIG. 25. The upper and lower guides 341a and 341b are provided so that the insert tray 35-2 may loosely move up and down in some degree.

Figure 26:
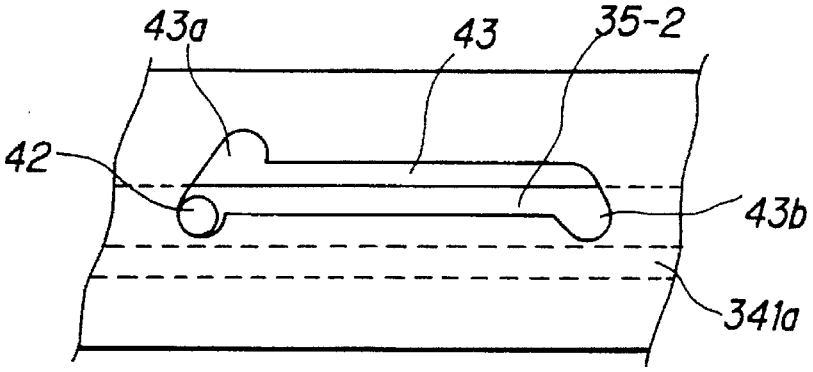
FIG. 26 is a plan view showing an example of a sliding structure of an insert tray in FIG. 25.

As shown in FIG. 26, the insert tray 35-2 has a pin 42 planted on each side face thereof so that these pins 42 project for regulating the sliding position. Each of the pins 42 is passed through an elongate slot 43 formed on each side of the bending portion 35*a* so that the insert tray 35-2 may move within the range of the elongate slot 43, and movement beyond the range may be prohibited.

The elongate slot 43 has slant holes 43*a* and 43*b* at both ends thereof. These slant holes 43*a* and 43*b* are formed in such angles that the pins 42 may easily come out from the recesses and the sliding movement can be readily made.

When the insert tray 35-2 is pushed toward the inner side from the position shown in FIG. 25, the pins 42 come off from respective slant holes 43*a* and are guided along the elongate slots 43 to fall into the slant holes 43*b* on the other side and is kept at that state. That is, the insert tray 35-2 cannot be further moved and is kept at the position. Referring to FIGS. 22 and 23, especially FIG. 23, in this sliding operation, the tray 35-2 is moved from a first position shown by the solid line to a second position shown by the broken line. That is, the front end of the insert tray 35-2 passes through the lower side of the pull-in roller 335 as seen in FIG. 22 and is placed so as to be opposed to the feed roller unit 34. In this case, as shown in FIG. 22, the detecting lever 33 fits into a cutout portion formed in the insert tray 35-2 so that the lever 33 is able to detect the front end of a document inserted by the pull-in roller 335.

When the insert tray 35-2 is pulled, pins 42 come out from slant holes 43*b* on the inner side and falls into slant holes 43*a* on the front side. In this condition, the document stocker 35 can be rotated on the pivots 35*b*. That is, the stocker 35 can be placed over the original cover 3 (in its folded state). When the document stocker 35 is placed on the original cover 3, pins 42 of the insert tray 35-2 move into the other ends of the slant holes 43*a*, whereby the movement of the insert tray 35-2 is restricted. Specifically, in the state shown in FIG. 21, pins 42 fall into slant holes 43*a* of elongate slots 43 whereby the insert tray 35-2 is constrained so that it cannot move relative to the document stocker 35. That is, as the document stocker 35 is folded, slant holes 43*a* are inclined in such a direction as to prohibit the sliding and keep the pins 42 at that position.

The rear side of the document stocker 35 or the side facing the side of the original cover 3 is used as the discharge tray 35-1 for receiving documents. This tray is positioned in opposition to the reference position 2*a* of the original table 2. As the document stocker 35 placed on the original cover 3 is rotated to be unfolded, the front end of the discharge tray 35-1 of the rear side of the document stocker 35 abuts the outer top panel 1*a* of the copier body so that the front end is opposed to the one side edge of the original table 2. The edge of the discharge tray 35-1 of the document stocker 35 is plunged into a depressed portion which is formed on the outer top panel 1*a*, as shown in FIG. 22. This structure allows the discharged document to be delivered to the discharge tray 35-2 in an assured manner.

Figure 27:
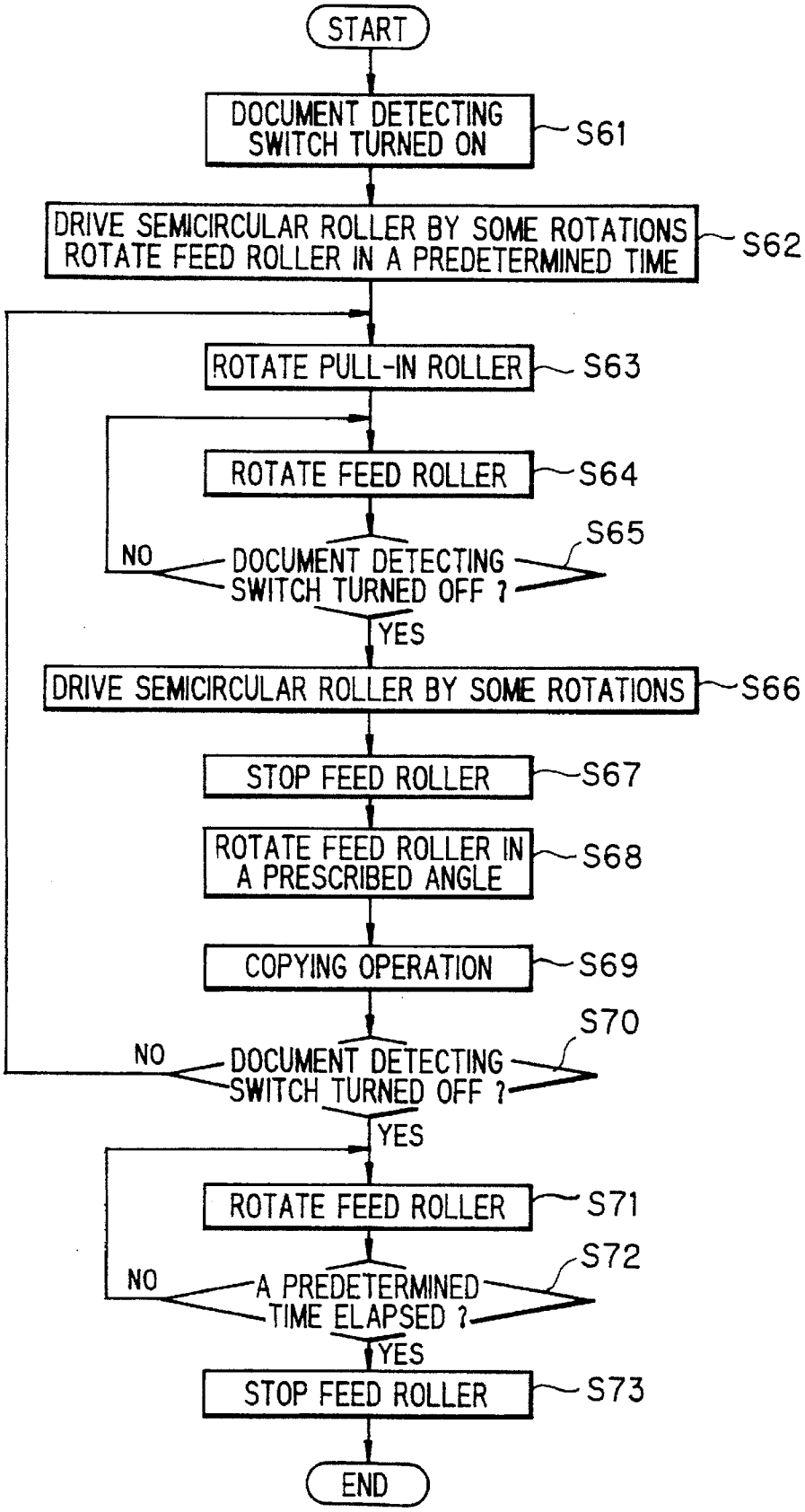
FIG. 27 is a flowchart showing operative control of different rollers in accordance with document feeding control of the invention.

Referring next to a flowchart shown in FIG. 27, the operation of the copier and the document feeder 30 will be described. FIGS. 21 and 24 show a state where the original cover 3 is closed with the document stocker 35 positioned over the original cover 3. From this setting, the document stocker 35 is rotated to this side to be opened. By this operation, the hook portion 37*a* of the raising member 37 meshes the engaging member 35*c*, as shown in FIG. 23, so that the document stocker 35 is lifted upward, creating the gap 'd' between the document pressing mat 3*b* and the original table 2.

Then, the insert tray 35-2 is slid or pushed into the side of the pull-in roller 335. This operation causes the pins 42 on the insert tray 35-2 to come off from the slant holes 43*a* of the elongate slot 43 formed on the side walls of the document stocker 35 and fall into the slant holes 43*b* on the other side. As a result, the front end of the insert tray 35-2 is positioned, as shown in FIG. 22, in contact with the pull-in roller 335 and in opposition to the nip of feed rollers 34.

In this state, the document feeder 30 becomes usable. That is, as a document D is inserted from the document inserting portion 32 along the top face of the document stocker 35, the detecting lever 33 is pressed up by the document D, whereby the document detecting switch is turned on (Step S61).

At the time of inserting the document, if, for example the left edge of the original table 2 in FIG. 21 is assumed to be a reference position for the placement of the document, the left side of the bending portion 35*a* of the document stocker 35 is adapted to coincide to the reference position, whereby it is possible to use the bending portion 35*a* to guide the front part of the document. By this arrangement, it is possible to deliver the document to the original table 2 in place with its front side aligned with the reference position. Although the bending portion 35*a* of the document stocker 35 is used as a regulating guide for one side edge of the document, a fixed guide positioned corresponding to the reference edge 2*b* of the original table 2 may be separately provided in the width direction of the document.

Another guide 45 for regulating and guiding another side edge in its width is provided as shown in FIG. 25 on the insert tray 35-2 so as to be movable in a direction perpendicular to the document inserting direction. This guide 45 is moved to be adjusted to the width of a document such that it becomes possible to convey the document regularly by guiding both ends of the document along the guide 45 and the one of bending portion 35*a* or the fixed reference edge of the fixed guide.

As the document is inserted, the inserted document operates the detecting lever 33 so that the document detecting switch, as detecting the document, turns on. In response to the detection, the feed roller 34*a* is driven to rotate in a predetermined period of time. At the same time, the semicircular roller 38 is driven in the direction to return the document toward the feed roller unit 34 (Step S62). This semicircular roller 38 is rotated by the driver so that the document, if any, may be conveyed toward the feed roller unit 34. This semicircular roller 38 will be stopped after the rotation of an integer number.

This drive of the semicircular roller is to discharge a document, if any, left behind at the time the previous copying operation. That is, in the state where a document is placed on the original table 2, if the document feeder 30 is to be used, the document stocker 35 is rotated as described above to be set in the right place where a document can be fed from the insert tray 35-2. At that moment the document left should be discharged. Suppose that a document is left behind on the original table 2 and this document is not discharged. In this condition, when another document is inserted and fed, the conveyance of the fed document is interfered with the residual document that is left behind, causing document jam or damages to both the fed document D and the residual document D1 to be discharged. For eliminating such accidents, the role of the above operation is important and vary effective as a means for solving this problem.

For this purpose, if in synchronization with the drive of the feed roller 34*a* the semicircular roller is rotated at a predetermined number of rotations, the rear end of the residual document D1 is delivered to the nip between the driven roller 34*b* constituting the feed roller unit and the original table 2, whereby the document D1 is discharged toward the discharge tray 35-1 by the drive of the feed roller unit 34. The period of driving the feed roller 34*a* is so set up as to be able to discharge the maximum-sized document specified for the original table 2. When the feed roller 34*a* is stopped after the lapse of this period, the front end of the document is discharged from the position of the driven roller 34*b*.

Here, since the driven roller 34*b* is positioned in correspondence to the reference position 2*a* of the original table 2, if the residual document is placed along the reference position 2*a*, the document is pressed onto the original table 2 by the driven roller 34*b*. Accordingly, the activation of the feed roller unit 34 in the aforementioned period of time may discharge the document. However, the placement of the document could more or less be deviated from the right place. Even in such a case, since the semicircular roller 38 rotates to convey the document toward the feed roller unit 34, the rear end can be inserted into the nip between the driven roller 34*b* and the original table 2, thus making it possible to discharge the document.

To achieve the above operation, in view of the document left behind, when an inserted document operates the detecting lever 33 and the document is detected, the operation for discharging the document placed on the original table 2 is effected as stated above. In this operation, the semicircular roller 38 is rotated in a predetermined period of time, whereby the document is conveyed to the nip between the driven roller 34*b* of the feed roller unit 34 and the original table 2. As the feed roller 34*a* rotates, the document held between the roller 34*b* and the original table 2 is discharged to the discharge tray 35-1 of the document stocker 35.

After the rotation in a predetermined period of time in order to effect the discharging operation of document state above, the drive of the feed roller 34*a* is stopped. At that moment, the pull-in roller 335 is started to drive (Step S63) so that the inserted document is delivered to the nip in the feed roller unit 34. When the inserted document reaches the nip, the feed roller 34*a* is re-started to rotate (Step S64), whereby the inserted document D is conveyed toward the original table 2. In this case, the feed roller 34*a* is stopped after a predetermined period of time. But this is not a must but the roller 34*a* may be kept on driving without halting.

In this conveying operation, when the rear end of the inserted document D has passed through the position of the detecting lever 33, the rear end is detected by the detective lever 33 (or the document detecting switch is turned off). This operation is not shown in FIG. 27. The moment this detection is done, the pull-in roller 335 is deactivated. The feed roller 34*a*, however, is kept on driving until the detecting lever 39 disposed on the downstream side for the document detecting switch detects the rear end of the document (Step S65).

As stated above, the conveyance of a document is started and when the rear end of the document is detected by the document detecting switch through the detecting lever 39 or the detecting switch is turned off by the fact that the document has passed therethrough, the rear end of the document conveyed should be positioned to the reference position 2*a* of the document table 2. To achieve this, the semicircular roller 38 is rotated by a predetermined number of rotations (Step S66). This rotation of the semicircular roller 38 is set at such a number as to be able to convey the rear end of the fed document by a distance more than the distance up to the nip between the driven roller 34*b* of the feed roller unit and the original table 2. Accordingly, as the semicircular roller 38 is rotated, it is possible to convey the document toward the feed roller unit 34. Thereafter, in synchronism with the starting timing of the rotation of the semicircular roller 38, the rotation of the feed roller 34*a* is stopped (Step S67). This is because that the rear end of the document conveyed is delivered to the nip between the driven roller 34*b* of the feed roller unit and the original table 2 and the semicircular roller 38 is driven to convey the document so that the rear end of the document may be aligned with the contacting nip of the driven roller 34*b* and the original table 2. As a result, any inclined conveyance can be corrected. That is, this operation is effective to align the whole part of the rear end to the contacting nip.

Thus, when a document D brought by some integer number of rotations of the semicircular roller 38 is placed aligned with the reference position 2*a* of the original table 2, automatic placement of the document D onto the original table 2 is complete and the rear end of the document is determined to be positioned at the reference position 2*a*. That is, when the contacting nip between the driven roller 34*b* and the original table 2 corresponds to the reference position 2*a*, the feed roller 34*a* is stopped so that the semicircular roller 38 is stopped after the predetermined number of rotations. In this condition, the feeding operation of the document D is complete as stated above with the rear end of the document D aligned with the reference position 2*a*.

Here, consider a case that the reference position 2*a* does not coincide with the contacting position between the driven roller 34*b* and the original table 2 but is deviated from the contacting position toward the document inserting side. Even is such a case, it is possible to position the rear end of the document at the reference position 2*a* by controlling the rotation of a rotational angle of the driven roller 34*b*. For this purpose, the feed roller 34*a* is rotated by a prescribed angle and stopped, in Step S68. This prescribed angle of rotation is associated with a rotational angle of the driven roller 34*b*. That is, the driven roller 34*b* should be rotated in such an angle as to correspond to the distance from the contacting position between the driven roller 34*b* and the original table 2 to the reference position 2*a*. If this angle or the rotational angle of the driven roller 34*b* corresponds to one rotation of the driven roller, the feed roller 34*a* is controlled to rotate so that the driven roller 34*b* may rotate by one rotation. Thus, the rear end of the document is adapted to register with the reference position 2*a* and surely be nipped between the driven roller 34*b* and the original table 2. Accordingly, the document will not be moved by external factors.

When the rear end of the thus inserted document D is positioned, the copier starts to perform the same copying operation as will be effected when the copy button 23 is pressed, whereby the copier effects reproducing procedures from the exposure to the discharge of copy paper (Step S69). In this case, since the copying operation is carried out with the rear end of the document D nipped between the driven roller 34*b* of the feed roller unit 34 and the original table 2, the copying operation can be completed without the document moved. Since the rear end of the document is positioned in the regular reference position, the whole image of the document can be reproduced.

As the copying operation of the thus inserted document D has finished, the apparatus starts to discharge the document. In this case, the document detecting switch detects whether a next document is inserted through the insert tray 35-2 (Step S70). If the insertion of a document is detected, the system returns to Step S63 to convey the inserted document D and activate the feed roller 34*a*. By this operation, the copy-finished document held between the driven roller 34*b* and the original table 2 is discharged by the rotation of the driven roller 34*b* while the inserted document is conveyed by the feed roller 34*a*. In this way, documents are conveyed so that the discharging operation is effected simultaneously with the insertion of a new document. In this operation, the insertion and discharge are effected as the two documents partially pass by each other.

On the other hand, if no document inserted is detected, the operation goes from Step S70 to Step S71 from where the copy-finished document is discharged. To perform this operation, the feed roller is activated in a predetermined period of time (Step S72) or in a required time for completely discharging the document from the original table 2. After the front end of the document passes through the driven roller 34*b* and reaches the discharge tray 35-1, the feed roller is stopped (Step S73). This period of driving is so set up as to be able to discharge the maximum-sized document specified for the original table 2, as mentioned above.

In this way, if a document inserted is detected after the completion of copying operation for the previous document, the system conducts the discharging operation simultaneously with the feeding operation of the inserted document, thus making it possible to reduce the processing time. Particularly, when the documents to be handled have the same size, the fed document and discharged document partially pass by each other. That is, after the discharged document passed by the driven roller 34*b*, the rear end of the fed document passes through the detecting lever 39. Accordingly, it is possible to simultaneously effect feeding and discharging of documents without causing any problem.

When a final document is discharged, the feed roller 34*a* is activated by the time corresponding to the maximum-sized document, at step S72. If time-waste of this kind should be eliminated, a time from when the front end of a document is detected until the rear end of the document is detected may and should be counted. That is, the feed roller 34*a* is driven at Step 72 in a time corresponding to the counted time. Thus, it is possible to save the time of driving, without needing to drive the roller in the time corresponding to the maximum-sized document. This configuration is also advantageous for surely discharging documents when various sizes of documents are inserted.

Specifically, if there are various sizes of documents to be copied, a second document detected may and should be fed only after a first document has surely been discharged. This operation is achieved as follows: That is, suppose that a next document is detected at Step S70. Since the size of a document whose copy has been finished was counted during its feeding, only the feed roller 34*a* is activated in conformity with the time counted, without driving the pull-in roller 335. After the lapse of this period of time, the pull-in roller 335 is activated. In this case, the feed roller 34*a* is kept on driving without stop and Steps S63, S64 . . . are effected, whereby the inserted document can be fed. During this feeding operation, the size of the document is detected. Thus, it is possible to achieve the above object. More clearly, it is possible to surely feed and discharge documents which have different sizes and to eliminate jeopardy of jamming due to the interference of the discharged document with the inserted document.

In this way, copying of each document is effected utilizing the document feeder 30. That is, the document whose copy has been finished is discharged to the discharge tray 35-1 while the inserted document is guided through the insert tray 35-2. As a result, inserted documents and discharged documents can be separately handled on the same side of the copier body.

In accordance with this embodiment, the document is fed in a direction perpendicular to the direction in which copy sheets are conveyed. However, it is also possible to configurated the system so that the document is conveyed in the same direction as the copy sheet is conveyed. That is, for example, the original cover 3 is adapted to be hinged on the right side in FIG. 21 while a document feeding port is formed on the opposite side to the hinged portion. In this arrangement, the document feeder 30 configurated as described above may and should be mounted.

As has been described heretofore, the document feeder 30 of this embodiment can be constructed by the simple means, so that it is possible to markedly contribute to reducing the cost. In the above description, the document stocker 35 for creating a gap 'd' between the original cover 3 and the original table 2 is configurated as holding documents etc., but this is not a must but a mere rotational member can be used, in place of the document stocker 35. However, since, in the above embodiment, the document stocker 35 has both functions, it is advantageous that the member can be used as a storage if the document feeder is not used.

In the embodiment of the invention, the original cover 3 is adapted to rise from the original table 2 by the lifting mechanism in link with the rotation of the document stocker 35 when the stocker is set to be used as the document guide. However, the invention should not be limited to this configuration. That is, it also possible to make the same operation by a lifting mechanism in which the original cover 3 is lifted up when a document is inserted.

Figure 28:
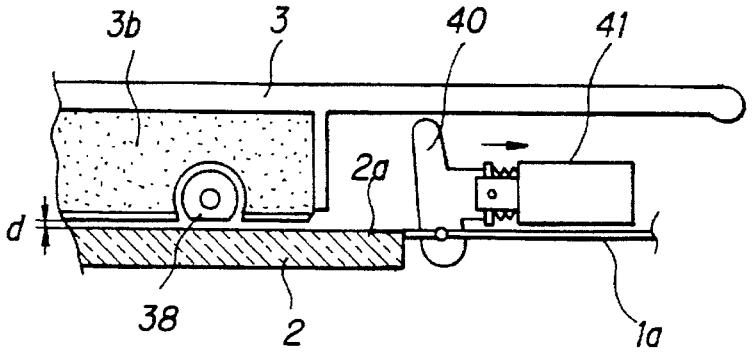
FIG. 28 is a sectional view showing another configurational example for raising an original cover from an original table in accordance with invention.

FIG. 28 shows a means of the example. That is, this means include: a moving piece 40 disposed in a position outside the document inserting region for the maximum-width document, for lifting the original cover 3 up; and a solenoid 41 disposed between the handgrip of the original cover 3 and the outer top face 1*a* of the copier body, for operating the moving piece 40. The moving piece 40 for lifting is rotatably supported by the outer plate 1*a* and the opposite part abuts the grip portion of the original cover 3 while the central portion is jointed to the solenoid 41.

When the solenoid 41 is not energized or not supplied with electric power, the moving piece 40 stays a little inclined in the counterclockwise direction. In this condition, no clearance 'd' is created between the original table 2 and the document mat 3*b*. That is, the document pressing mat 3*b* is in close contact with the original table 2. As the solenoid 41 is energized by electric power, the moving piece 40 moves to a position shown in FIG. 28 so that the original cover 3 is raised to create a gap 'd' between the document mat 3*b* and the original table 2.

In the above arrangement, the document stocker 35 is rotated to be set into the state shown in FIG. 22. Then, the insert tray 35-2 is shifted toward the feed roller unit 34. In this situation, if a document is inserted, the detecting switch is activated through the detecting lever 33. Accordingly, the solenoid 41 is energized to rotate the moving piece 40, whereby the original cover 3 can be raised. In this condition, the pull-in roller 335 and the feed roller 34*a* are activated as described with reference to FIG. 27, whereby it is possible to convey the inserted document to the original table 2.

This operation will be explained using the above-described flowchart of operation control, shown in FIG. 27. As a document is detected at S61, this activates the solenoid 41 so as to lift up the original cover 3 from the original table 2 by a gap 'd', as shown in FIG. 28. Then the steps after S62 are effected. When the operation reaches Step 67, the feed roller 34*a* is stopped. In this situation or in a state where the rear end of the document stopped is nipped by feed roller 34*a*, the solenoid 41 is deactivated.

The deactivation causes the original cover 3 to press down the fed document with its rear end position at the reference position 2*a* on the original table 2 so that the copied surface of the document may be brought into close contact with the original table 2. Then, copying operation is effected at S69. As the copying operation is complete, the feed roller 34*a* is rotated in order to discharge the document. Before this rotation, the solenoid 41 should be energized to space the document pressing mat 3*b* from the original table 2. As the above steps are successively repeated, it is possible to effect copying operation for a desired number of original documents, by using the document feeder 30. Since, in the document feeder 30 of the invention, the original cover 3 presses the document inserted against the original table, some wrinkles and irregularity of the sheet document, if any, can be smoothed, whereby it is possible to create qualified copies free from shadows due to the wrinkles and irregularity.

After the completion of copying and before the activation of the feed roller 34*a* to discharge the document, the original cover 3 can be lifted up. That is, if the solenoid 41 is energized at the time Step S69 is completed, the original cover 3 is raised from the original table 2. Since the system starts to discharge the document D in this condition, the advance of the document will not be disturbed by the original cover 3. As a result, it is possible to convey the document D smoothly. In this case, if the conveying force by the feed roller 34*a* is enough great as compared to the pressing force, it is possible to discharge the document even if the original cover 3 is not lifted up from the original table 2 or in one word, the document is pressed. In such a case, only the rotation of the feed roller 34*a* may be effected enough, without energizing the solenoid 41. However, in order to feed a document, it becomes important to raise the original cover 3 from the original table 2.

In the above description of the embodiment, if a document remains at the time a first document is inserted, the residual document should be discharged. For this purpose, the feed roller 34*a* is rotated in a predetermined period of time while the semicircular roller 38 is driven by some or several number of rotations. During this operation, the inserted document is made to wait as placed on the insert tray 35-2 until the discharge of the residual document is complete. Therefore, there is a problem that it takes long time before starting the copying operation since the first document should be conveyed to the original table 2 only after the lapse of the above waiting time.

To solve the above problem, the system is constructed such that when an inserted document is detected, the semicircular roller 38 is driven by some or several number of rotations and at the same time the pull-in roller 335 is made to rotate. By this operation, the inserted document can be fed at the same time the semicircular roller 38 drives the residual document from the original table 2 toward the feed roller unit 34. Then, before the prescribed number of rotations of the semicircular roller is complete, the feed roller 34*a* is made active. As a result, the residual document, as being held between the driven roller 34*b* and the original table 2, is discharged while the document fed through the pull-in roller 335 is nipped and conveyed by the feed rollers 34*a* and 34*b* toward the original table 2.

A specific operation of the above construction will be described with reference to the flowchart shown in FIG. 27. As insert of a document is detected by the detecting lever 33 at Step S61, the semicircular roller 38 is driven by some or several number of rotations and the pull-in roller 335 is activated at the same time (Step S62). After the activation, the feed roller 34*a* is started to rotate before driving of the semicircular roller 38 by the prescribed number of rotations is complete. Thereafter, the same operations after Step S64 follow. During the operation, the inserted document and the discharged document are made to partially pass by each other and after the completion of the discharge, the rear end of the document is detected by the operation of the detecting lever 39 (i.e., the lever is turned off) (Step S65).

In response to this detection, the feed roller 34*a* is deactivated (Step S67) while the semicircular roller 38 is driven by some or several number of rotations (Step S66), whereby the rear end of the document is made to register with the contacting portion between the original table 2 and the driven roller 34*b* of the feed roller unit 34. Then, the feed roller 34*a* is rotated by the prescribed angle, so that the rear end of the document can be positioned and stopped at the reference position on the original table 2.

In this way, with a timing when the front end of the inserted document is detected (i.e., turned on) by the operation of the detecting lever 33, as the semicircular roller 38 is driven by some or several number of rotations, the rear end of the residual document is delivered to under the driven roller 34*b* in the feed roller unit. Simultaneously, the pull-in roller 335 is activated to rotate, so that the front end of the inserted document is delivered to the feed roller 34*a*. In this condition, as the feed roller 34*a* is activated to rotate, the feeding operation of the inserted document and the discharge of the residual document are simultaneously done. As a result, the rear end of the inserted document passes through the feed roller 34*a* in synchronization with the timing when the front end of the residual document passes through the discharge (driven) roller 34*b*. Then the rear end of the inserted document operates the detecting lever 39 so that the passage of document is detected thereby. At that timing, the feed roller 34*a* is stopped, but the discharge of the residual document has already been complete as stated above. Accordingly, there is no problem as to the discharge of the document.

Thus, in response to the detection of a first inserted document, the feeding operation of the first inserted document can be done simultaneously with the discharging operation of a remaining document, thus making it possible to attain the aforementioned object or to reduce the copy-activating time for a first document.

In the above explanation, the feed roller 34*a* is activated after some rotations of the semicircular roller 38. As long as the operation is normal, the feed roller 34*a* may be activated simultaneously with the semicircular roller. In such an operation, the discharge of a residual document can be done at the same time without any problem since the document is normally placed and held between the lower part of the driven roller 34*b* and the original table 2. Then, after the discharge of the residual document is complete, the rear end of the inserted document passes through the feed roller 34*a*. Therefore, the three roller may be activated simultaneously.

Nevertheless, if the residual document is not placed in alignment with the reference position 2*a*, the discharging operation could start only after the rear end of the residual document has been brought to the lower part of the driven roller 34*b* by the rotation of the semicircular roller 38. In this case, the front end of the inserted document could reach the feed roller 34*a* before the rear end of the residual document reaches the driven roller 34*b*. As a result, there is a jeopardy that the driven roller 34*b* is stopped despite that the front end of the residual document is nipped or the document has not yet been discharged completely. To avoid this situation, the configuration of control described above should be adopted. That is, when the semicircular roller 38 is activated beforehand so as to send the rear end of the residual document toward the driven roller 34*b*, the front end of the residual document can pass through before the rear end of the inserted document passes through the feed roller 34*a*.

The above operation can and should be effected properly when the residual document is equal in size to or smaller than the inserted document. Accordingly, if a document of maximum-size is inserted, the feeding operation can be started in synchronism with the start of the discharging operation, regardless of the size of the residual document.

In accordance with the above configuration, it is possible to start both the discharging operation and the feeding operation, simultaneously, in response to the detection of an initial document inserted. Accordingly, it is possible to reduce the feeding time of a first document, and thus it is possible to reduce the copying time.

Next, assume that a document to be copied is smaller than a residual document. In this case, it is apparent that a problem of incompleteness of discharging occurs if all the rollers are activated simultaneously. To eliminate the problem, the operation should be controlled as follows: when an inserted document is detected by the detecting lever 33, the semicircular roller 38 and the feed roller 34*a* are activated while the pull-in roller 335 is stopped to rotate. As the most disadvantageous condition, it is assumed that the residual document has the maximum-size while the inserted document has the minimum-size. The feed roller 34*a* is driven until both the feeding and discharging operations can be allowed simultaneously. After the passage of this waiting time, the pull-in roller 335 is activated. As a result, the feeding operation of the inserted document is operated in parallel with the discharging operation of the residual document, thus making it possible to reduce the copy-activating time for the first document. Besides, regardless of the sizes of the documents, the feeding operation finishes after the discharging operation has completely been finished. As a result, it is no more necessary to limit the size of inserted documents. That is, if any documents different in size are fed, it is possible to partially effect simultaneous discharging and feeding operations of documents.

The waiting time may and should be set up at a difference between the time for discharging the maximum-size document and the time for feeding the minimum-size document. By this setup, even if a minimum-size document is inserted, a residual document of maximum-size is started to discharge beforehand. When the remaining length of the maximum-size document to be conveyed coincides with the length of the minimum-size document, the inserted document of minimum-size is started to be fed in parallel. Accordingly, when the discharge is complete, the inserted document of minimum-size is released from the feed roller 34*a*. That is, even if the documents to be handled differ in size, it is possible to reduce the time required for feeding a first document, without needing the detection of the document size, whereby it becomes possible to reduce the time for first-copy activation.

The above operation control is optimally applied to when feeding and discharging operations of a second document or thereafter are effected. That is, if documents to be copied are of the same size, the feeding and discharging of documents are effected in parallel, as shown in FIG. 27. If documents to be copied are not of the same but different sizes, a different-size mode should be setup through the unillustrated control panel 22. In this mode, if an inserted document is detected at Step S70, the feed roller 34*a* and the semicircular roller 38 are activated. Then, after the lapse of time which is equivalent to the differential length between the maximum-size and minimum-size documents, the pull-in roller 335 is activated and then Step S63 and the following steps are effected. As a result, when documents of different sizes are to be copied or even when the size of documents to be copied is unknown, a previous document can surely be discharged before the completion of the feeding operation. Accordingly, there is no more accident such as conveyance defects or stoppage of the discharged and inserted documents overlapped each other.

Although the above configuration of control is attained when the pull-in roller 335 is provided, provision of the pull-in roller 335 is not the requirement of the present invention. More specifically, the requisite composing elements include: a detecting lever 33 for detecting an inserted document; a feed roller 34*a* disposed downstream of the detecting lever 33 and conveying the detected document to the original table 2; and a semicircular roller 38 provided on the side of an original cover 3 and activated after the document placed on the original table 2 so that the rear end of the document is delivered to be in alignment with the contacting position between a driven roller 34*b* of a feed roller unit 34.

In this arrangement, it is assumed that the contacting position between the original table 2 and the driven roller 34*a* as a constituent of the feed roller unit is made coincident with the reference position 2*a*. After the rear end of the document has passed through the feed roller 34*a*, the feed roller 34*a* is stopped. In this condition, the semicircular roller 38 is activated by a prescribed number of rotations, whereby it is possible to bring the rear end of the document in alignment with the reference position 2*a*. In this operation, if the semicircular roller 38 is set up to be driven by a greater number of rotations than the actual distance to be conveyed, it is possible to correct inclined conveyance of a document, so that the rear end of the document can be made in alignment with the contacting position between the driven roller 34*b* and the original table 2, whereby positioning of the document at the reference position 2*a* can be established.

There is a case that the reference position 2*a* does not correspond to the contacting portion of the driven roller 34*b*, but is set at a site somehow deviated toward the document inserting side. In such a case, after the semicircular roller 38 is deactivated, the feed roller 34*a* is rotated by a limited rotational angle so that the rear end of the document can be surely positioned. In this case, the rear end of the document is nipped between the driven roller 34*b* and the original table 2, so that the document will be moved by vibrations and air-flow etc.

Parallel control of both the feeding operation of a first inserted document and the discharging operation of a residual document on the original table 2 can be attained by providing the aforementioned pull-in roller 335 and controlling it in a proper manner.

Further, in order to establish separated document paths for discharged and inserted documents, provision of separate trays, namely, the inert tray 35-2 and the discharge tray 35-1 is requisite. In this case, the stocker 35 is made to serve as the discharge tray 35-1 while another slidable plate relative to the document stocker 35 is provided as the insert tray 35-2, separately from the tray 35-1. In this configuration, the insert tray 35-2 is used as a guide tray for surely guiding inserted documents toward the feed roller 34*a*, whereby separation of the insert tray from the discharge tray 35-1 can be assured. The sliding range and state of the insert tray is limited by providing elongate slots 43, so the insert tray can be positioned, as described above, in a site where document can be properly guided to the feed roller 34*a* when it is needed. In this case, the elongate slot 43 is formed at extremes with the slant holes 43*a* and 43*b*, which make the positioning and sliding operation easy.

Figure 29:
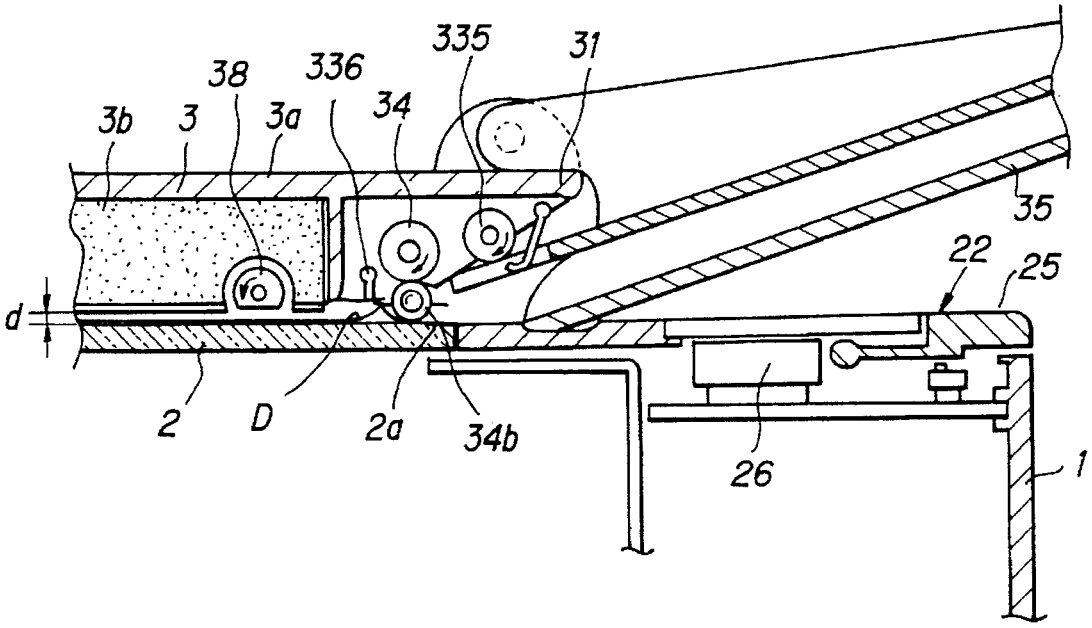
FIG. 29 is a sectional view showing a configurational example of a driven roller constituting a feed roller unit in order to handle a curled document etc., in a document feeding apparatus of the invention.

There is a case that the rear end of a document is difficult to position due to its curled end. FIG. 29 shows a method to deal with the situation. In the figure, a plurality of blade-shaped soft paddles 34*b*-1 are provided radially on the surface of the driven roller 34*b* of the feed roller unit 34. In this configuration, a curled document D, either it is curled upward or downward, can be conveyed by the driven roller 34*b* as it is pressed down from the top thereof by the paddles 34*b*-1. Therefore, it is possible to introduce the rear end of the document D to the nip between the driven roller 34*b* of the feed roller unit and the original table 2, and thereby surely position the rear end of the document at the reference position 2*a*.

The discharged document is delivered out to the discharge tray 35-1 of the document stocker 35 and stacked therein. Since this discharge tray 35-1 is located below the insert tray 35-2, it is difficult to take out discharged documents from the discharge tray 35-1. In order to ease the removal, a groove 35-2*a*, for example is formed on a part of the insert tray 35-2 as shown in FIG. 25. That is, the insert tray is adapted to be rotatable on this part. This is also the reason the lower guide 341*b* is formed shorter than the upper guide 341*a* so that the rear end of the insert tray 35-2 may be taken off from the upper and lower guides, especially from the lower guides 341*b* when the insert tray 35-2 is slid to the position where it is opposed to the feed roller 34*a*. Accordingly, when the insert tray 35-2 is slid to the position where the lower guides 341*b* are absent so as to free the rear end of the tray, the rear portion can be rotated on the groove 35-2*a*, whereby it is possible for the user to easily pick up the documents discharged.

After completion of the pickup, as the insert tray 35-2 is drawn by returning the rear end part of the insert tray 35-2 to the original state, guided by the upper and lower guides 341*a* and 341*b* respectively, the tray is accommodated inside the document stocker 35. As the accommodation is complete, the document stocker 35 can be rotated as shown in FIG. 21, so as to be folded or placed on the original cover 3.

The semicircular roller 38 for positioning the document inserted is to return the document toward the feed roller unit 34 and therefore the shape of the roller should not be limited to that specified in the foregoing description. That is, a roller is usable for the semicircular roller 38 as long as a certain gap, for example, a clearance of d or more can be created from the original table 2 when the document is not to be conveyed. This can be attained by using a cylindrical roller having a roller shaft eccentric. That is, when the eccentric roller is used, the roller is positioned such that the short-diameter side is opposed to the original table 2 when it is stopped. With this arrangement, the eccentric roller is driven by an integer number of rotations so as to be able to convey the required distance when it is activated. Thus, it is possible for the eccentric roller to have the same effect as the semicircular roller 38.

Further, provision of the pull-in roller 335 makes it unnecessary the documents be inserted one by one through the insert tray 35-2. That is, if a stack of documents to be copied is placed on the insert tray 35-2, the pull-in roller 335 can be controlled for each document feeding operation so as to feed documents one by one and discharge them at the same time.

Specifically, as a document is inserted and the fact is detected through the detecting lever 33 as a document detecting switch, the topmost document is delivered by the rotation of the pull-in roller 335 toward the feed roller 34*a*. In response to the feeding, the feed roller 34*a* is activated so as to convey the document toward the original table 2. Then, the pull-in roller 335 is halted after the lapse of time equivalent to the conveyance of, for example, the minimum-size document while the feed roller 34*a* is kept on rotating to convey the document. As stated above, the semicircular roller 38 is activated by a prescribed number of rotations, whereby the document can be positioned at the reference position 2*a* on the original table 2. After the placement of the document is thus complete, copying operation is effected. As the copying is complete, in order to feed a next document simultaneously with discharging the document whose copy has been already made, the pull-in roller 335 is activated. This series of operations is repeated until all the documents stacked are delivered by the pull-in roller 335. As a final document is delivered by the roller 335 and the rear end of the document is detected as passing through the detecting lever 33, the document feeding is complete. In the discharging operation after copying of the document is complete, the pull-in roller 335 will not be activated but only the discharging operation is effected.

Thus, if a stack of documents is placed on the document-insert tray 35-2, it is possible to feed and discharge documents simultaneously. This operation can be made possible by the provision of the pull-in roller 335. That is, the pull-in roller 335 allows documents stacked on the tray to be delivered and discharged, one by one.

As has been stated above, in accordance with image forming apparatus of the invention, since a simple document feeder is provided which includes a feeding means disposed on one side of the original table for delivering documents into between the closed original cover and the original table, it is possible to reduce the cost as of a copier with a document feeder.

In the above case, when a document is fed to the original table using the document feeder, the whole part inclusive of the rear end of the document can be placed on the original table. Particularly, the document to be fed can be made in alignment with the reference position on the original table and stopped therein. Accordingly, it is possible to duplicate the whole image of the document without any image loss and the image formed can be made correspondent to a copy sheet fed, to form a regular image.

Further, a document whose copy has been complete can be conveyed to a predetermined site by effecting the same driving operation with that for feeding the document. Accordingly, it is possible to feed a next inserted document to the original table in the course of the previous document being discharged. As a result, without waiting the completion of the discharging operation, it is possible to start the feeding operation in parallel with the discharging operation, whereby it is possible to shorten the time for starting copying operation.

Since the pull-in roller is provided in the document guiding path before the feeding means, first insert of a document is able to cause a residual document, if any, to discharge in parallel with the feeding operation. Accordingly, it is possible to eliminate jeopardy of jamming, conveyance damages due to the residual document, as well as to reduce the time for starting a first copying operation.

Since two-storied trays, namely, insert and discharge trays, are provided in order to separate discharged documents from inserted documents and the insert tray is formed to be slidable, it is possible to surely guide the inserted document to the feeding means as well as to surely separate discharged documents.

What is claimed is:

1. An image forming apparatus equipped with a document feeder, comprising:

an original table disposed on the top surface of the image forming apparatus body and having an original document placed thereon and exposing the original image to light; and an original cover hinged pivotably on one side thereof to be opened and closed for pressing a document onto said original table, said document feeder comprising:

a rotational member hinged pivotably on the opposed side to the hinged portion of said original cover so as to be rotatable between the top surface of said original cover and the top panel surface of the image forming apparatus body in which said original table is formed;

a feeding means disposed in a document inserting portion formed between said original cover and said top panel surface when said original cover is closed, for conveying an inserted document toward said original table; and a lifting mechanism for raising said original cover from said original table when said rotational member is rotated toward said panel surface of the image forming apparatus body.

2. An image forming apparatus equipped with a document feeder according to claim 1, wherein said rotational member is constructed so that a storage space is created in cooperation with said original cover when said rotational member is closed over said original cover and so that said rotational member is also used as a document guide for an inserted document when said rotational member is rotated onto said panel plate.

3. An image forming apparatus equipped with a document feeder according to claim 2, further comprising:

a detecting means disposed on a document inserting side of said feeding means, for detecting insert of a document; and a controlling means for controlling the drive of said feeding means, based on the document detection by said detecting means.

4. An image forming apparatus equipped with a document feeder according to claim 1, further comprising:

a detecting means disposed on a document inserting side of said feeding means, for detecting insert of a document; and a controlling means for controlling the drive of said feeding means, based on the document detection by said detecting means.

5. An image forming apparatus equipped with a document feeder, comprising:

an original table disposed on the top surface of the image forming apparatus body and having an original document placed thereon and exposing the original image to light; and an original cover hinged pivotably on one side thereof to be opened and closed for pressing a document onto said original table, said document feeder comprising:

a rotational member hinged pivotably on the opposed side to the hinged portion of said original cover so as to be rotatable between the top surface of said original cover and the top panel surface of the image forming apparatus body in which said original table is formed;

a feeding means disposed in a document inserting portion formed between said original cover and said top panel surface when said original cover is closed, for conveying an inserted document toward said original table;

a lifting mechanism for raising said original cover from said original table when said rotational member is rotated toward said panel surface of the image forming apparatus body;

a detecting means disposed on a document inserting side of said feeding means, for detecting insert of a document; and a controlling means for controlling the drive of said feeding means, based on the document detection by said detecting means, said document feeder being characterized in that said controlling means activates said feeding means in response to the detection on the front end of an inserted document and deactivates said feeding means in response to the detection on the rear end of the document, whereby the document is kept with the rear end thereof held by said feeding means; and after completion of image forming of the document, said feeding means is driven in the reverse direction.

6. An image forming apparatus equipped with a document feeder, comprising:

an original table disposed on the top surface of the image forming apparatus body and having an original document placed thereon and exposing the original image to light;

an original cover hinged pivotably on one side thereof to be opened and closed for pressing a document onto said original table;

a document tray hinged pivotably on the opposed side to the hinged portion of said original cover so as to be rotatable between the top surface of said original cover and the top panel surface of the image forming apparatus body in which said original table is formed;

a feeding means disposed in a document inserting portion formed between said original cover and said top panel surface when said original cover is closed, for conveying an inserted document toward said original table; and a lifting mechanism for raising said original cover from said original table when said document tray is rotated toward said panel surface of the image forming apparatus body, wherein said document feeder has a discharging means disposed between said original cover and said original table for pushing out the document placed on said original table toward the opposite direction to the document inserting portion, when said document tray is unfolded on the top panel surface of the apparatus body.

7. An image forming apparatus equipped with a document feeder according to claim 6, wherein said feeding means effects reverse-rotation drive for discharging a document remaining on said original table, through a space formed between said document tray and said panel surface on the top of the image forming apparatus body, preceding to effecting forward-rotation drive to feed an inserted document toward said original table.

8. An image forming apparatus equipped with a document feeder according to claim 6, wherein said feeding means is composed of upper and lower rollers and an additional roller disposed below said lower roller and in link therewith; and a document is conveyed onto said original table by said upper and lower rollers in said feeding means while said additional roller in cooperation with said lower roller in said feeding means discharges the document placed on said original table.

9. An image forming apparatus equipped with a document feeder according to claim 6, further comprising an original-cover built-in feeding means disposed on a document inserting side of said original cover and driven by the driving shaft of said feeding means.

* * * * *